US010982902B2

(12) United States Patent
MacRae

(10) Patent No.: US 10,982,902 B2
(45) Date of Patent: Apr. 20, 2021

(54) STAVE COOLER

(71) Applicant: MacRae Technologies, Inc., Hayward, CA (US)

(72) Inventor: Allan J. MacRae, Hayward, CA (US)

(73) Assignee: MacRae Technologies, Inc., Hayward, CA (US)

( * ) Notice: Subject to any disclaimer, the term of this patent is extended or adjusted under 35 U.S.C. 154(b) by 17 days.

(21) Appl. No.: 16/926,649

(22) Filed: Jul. 11, 2020

(65) Prior Publication Data

US 2020/0348080 A1 Nov. 5, 2020

Related U.S. Application Data

(63) Continuation-in-part of application No. 16/712,912, filed on Dec. 12, 2019, now Pat. No. 10,684,078, and a continuation-in-part of application No. 16/290,922, filed on Mar. 3, 2019, now Pat. No. 10,954,574, which is a continuation-in-part of application No. 13/148,003, filed on Dec. 23, 2011, now Pat. No. 10,247,477, and a continuation-in-part of application No. 16/101,418, filed on Aug. 11, 2018, now Pat. No. 10,364,475, which is a continuation-in-part of application No. 15/815,343, filed on Nov. 16, 2017, now Pat. No. 9,963,754, said application No. 16/290,922 is a continuation-in-part of application No. 13/147,996, filed as application No.

(Continued)

(51) Int. Cl.

| | |
|---|---|
| ***F27D 1/12*** | (2006.01) |
| ***C21B 7/10*** | (2006.01) |
| ***F27D 9/00*** | (2006.01) |

(52) U.S. Cl.

CPC ..... *F27D 1/12* (2013.01); *C21B 7/10* (2013.01); *F27D 9/00* (2013.01); *F27D 2009/001* (2013.01); *F27D 2009/0062* (2013.01)

(58) Field of Classification Search

CPC ..... F27D 1/12; F27D 9/00; F27D 2009/001; F27D 2009/0062; C21D 7/10

USPC ... 266/190, 193, 46, 241, 167, 194, 99, 280, 266/78, 286; 29/428; 432/83; 165/168, 165/170, 169

See application file for complete search history.

(56) References Cited

U.S. PATENT DOCUMENTS 7,549,463 B1 * 6/2009 Schmeler ..... F28F 3/12 165/168

9,121,076 B2 * 9/2015 Smith ..... F27D 1/0003

(Continued)

*Primary Examiner* — Scott R Kastler

*Assistant Examiner* — Michael Aboagye

(74) *Attorney, Agent, or Firm* — Main Law Cafe; Richard Brewster Main

(57) ABSTRACT

A stave cooler for a furnace that always includes a liquid coolant piping cast inside. A stave cooler body includes a hot face and a backside and a liquid coolant piping cast inside between the hot face and the backside. A single steel collar on the backside of each stave is engineered to support the entire weight of the stave cooler. Any and every external connection of the liquid coolant piping are collected and routed together through the single steel collar. These stave coolers are limited to those mountable only from the inside of steel containment shells provided with a matching penetration. The single steel collar and a cover plate accommodate and provide a gas-tight seal by a continuous welding of the single steel collar to each steel containment shell.

6 Claims, 14 Drawing Sheets

Related U.S. Application Data

PCT/US2011/030591 on Mar. 30, 2011, now abandoned.

(60) Provisional application No. 61/318,977, filed on Mar. 30, 2010.

(56) References Cited

U.S. PATENT DOCUMENTS

| | | | | |
|---|---|---|---|---|
| 9,963,754 | B2 * | 5/2018 | MacRae | F28F 21/082 |
| 10,222,124 | B2 * | 3/2019 | Smith | F27B 1/14 |
| 10,364,475 | B2 * | 7/2019 | MacRae | F27D 1/141 |
| 2019/0256936 | A1 * | 8/2019 | MacRae | F27B 3/24 |
| 2019/0271049 | A1 * | 9/2019 | MacRae | C21B 7/10 |

* cited by examiner

Tuyers and Hearth below not Shown 206, 208, 214
204
204
202
thimble cover plate 212
couplers 214
outside-the-shell adapter plate 216
206-216
gas-tight to furnace shell
206-214
pipe box 210
thimble sleeves 208
pipe inlet and outlet ends 206
404
404
406
404
404
200
202
stave cooler 108
up furnace shell 114
216
212
steel pipe "stuffing" box 210
406
406 stuffing
pipe couplings 214
404
206
finished stave casting 200, 402, 206, 202
pipe inlet/outlets embedded in copper casting
warping corner control seat boss 404 typ of 4
helicoil cast-in steel frame 202
exposed face after flush casting
202 cast-in steel frame
206
cast-in nickel-alloy pipe circuit 402
404
copper stave panel 200
400 shotcrete up 511a 510a
513a 512a
513b 512b
511b 510b
common
opening
516
weld
515
500 stave cooler
502 metal panel
514
520
522
brick
524
horizontal ribs
and grooves
in hot-face
504
furnace steel
containment
shell
508, 510-513
pipe circuit and
loops of cooling pipe lower brick rows are preferably installed previous to the current brick row, but not necessarily. Any brick can be replaced later without affecting adjacent ones.

STAVE COOLER

APPLICATION'S CROSS REFERENCE TO RELATED APPLICATIONS

This application Ser. No. 16/926,649 is related to furnace stave coolers cast only from cast iron or only from cast copper, and those furnace stave coolers that cast-in coolant piping of steel in cast iron, and those furnace stave coolers that cast-in coolant piping of copper-nickel alloy in cast copper.

This application Ser. No. 16/926,649 is a continuation-in-part of application Ser. No. 16/712,912 filed Dec. 12, 2019 which discloses "a circuit of [thin wall] Schedule-40 copper-nickel (CuNi) alloy coolant pipe positioned inside the casting of the copper furnace block cooler that fused in its entirety inside along a CuNi-Cu interface between them".

This application Ser. No. 16/926,649 is a continuation-in-part of application Ser. No. 16/290,922 filed Mar. 3, 2019 which discloses the collection and grouping of all the inlet/out ends of all the cast-in coolant piping out and through a common opening in a single steel collar (aka manifold) that makes for full weight support and gas-sealing inside and through a steel containment shell.

In turn, application Ser. No. 16/290,922 filed Mar. 3, 2019 is a continuation-in-part of application Ser. No. 13/148,003 filed on Dec. 23, 2011, now U.S. Pat. No. 10,247,477 (which is related to "at least one cooling fluid inlet and at least one cooling fluid outlet for the flow of cooling fluid to and from the plate cooler stave from outside the furnace.") application Ser. No. 16/290,922 disclosed "Other embodiments may use copper-nickel [piping] instead of MONEL-400", "because such bonds better to the copper casting being poured and the hot liquid copper will not 'burn through' during casting".

And application Ser. No. 16/290,922 filed Mar. 3, 2019 is itself a continuation-in-part of application Ser. No. 16/101,418, filed Aug. 11, 2018, now U.S. Pat. No. 10,364,475 issued Jul. 30, 2019, which related to single steel coolant-collar penetrations of cast-iron and cast-copper stave coolers in furnace steel containment shells. This is a continuation-in-part of application Ser. No. 15/815,343 filed Nov. 16, 2017, now U.S. Pat. No. 9,963,754, that related to "improved stave coolers that each hang together inside steel shelled furnaces by a single neck extended out through a steel jacketed collar". And has "a body of cast copper alloyed to balance its thermal conductivity, pipe bonding, strength, and small grain properties". Application Ser. No. 15/815,343 disclosed "A pure crystalline formation of the copper during casting is not preferred because such copper castings will not bond well with the coolant piping." And, "A small grain copper is best, but not at the expense of electrical conductivity quality control measures that fall below a minimum of 80% of International Annealed Copper Standard (IACS)."

Application Ser. No. 16/290,922 is also a continuation-in-part of application Ser. No. 13/147,996 filed Dec. 23, 2011, wherein a gas-tight seal of a steel protection pipe surrounds a water pipe and the protection pipe serves as a sealed, secondary cast-copper or cast-iron stave support.

Application Ser. No. 13/147,996 is a National Stage Entry of PCT/US11/030591 filed Mar. 30, 2011 (related to gas-tight seals of steel protection pipes around stave coolant water pipes), and application Ser. No. 13/147,996 claims priority from Provisional application 61/318,977 filed Mar. 30, 2010 (related to gas-tight seals of flared, steel protection pipes embedded into a stave body around stave coolant water pipes)

FIELD OF INVENTION

Embodiments of the present invention relate to blast furnaces, the stave coolers used inside them, and the hardware used to mount these stave coolers and connect and circulate coolants. More particularly, embodiments of the present invention embed a steel box strong enough to support the full weight of the stave and made gas-tight to contain lethal process gases inside the steel containment shells associated with blast furnaces.

BACKGROUND

Purpose of water-cooled components like stave coolers in blast furnaces is to establish a slow-wearing and stable blast furnace crucible. Brick linings and refractories last longer and wear more slowly when forcibly cooled.

What is needed now is a closed steel "can" that can be attached well enough to the backside of a cast copper/iron stave cooler that it will not pull off after several years of service and that will continue to contain lethal process gases inside for its entire campaign life. All the while supporting the 3,000+ kg weight of a ten foot tall stave cooler inside the blast furnace shell.

SUMMARY OF THE INVENTION

Briefly, a stave cooler for a furnace always includes at least one independent liquid coolant piping circuit cast inside. Each has a stave cooler body with a hot face and a backside and a liquid coolant piping cast inside between the hot face and the backside. A single steel collar on the backside of each stave is engineered to support the entire weight of the stave cooler. Any and every external connection of the liquid coolant piping circuits are collected and routed together through the single steel collar. These stave coolers are limited to those mountable only from the inside of steel containment shells provided with a matching penetration. The single steel collar and a cover plate accommodate and provide a gas-tight seal by a continuous welding of the single steel collar to each steel containment shell.

BRIEF DESCRIPTION OF THE DRAWINGS

FIG. 2A represents this assembly in exploded assembly view, and shows a thimble cover plate that slips over the several thimble sleeves installed on the water pipe inlet and outlet ends. The thimble cover plate is welded to the pipe box and all the thimble sleeves for a gas-tight containment of any lethal processes gases that snake around behind the stave. The distal ends of the water pipe inlet and outlet ends are fitted with pipe couplers;

FIGS. 2A-2D do not show any material that may be stuffed inside the pipe box before it is sealed up;

DETAILED DESCRIPTION OF THE PREFERRED EMBODIMENTS

Figure 1:
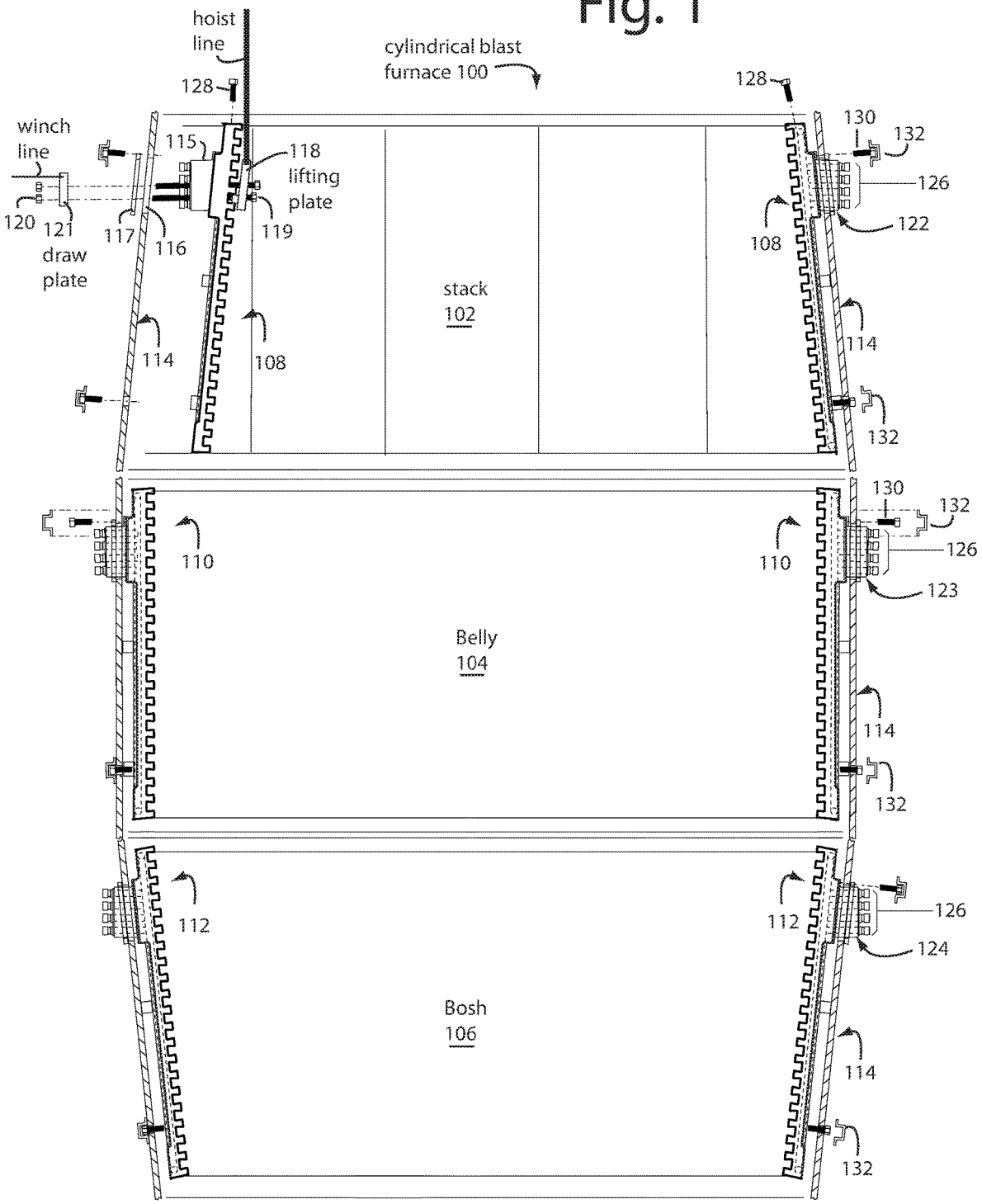
FIG. 1 is a cross sectional view diagram of an upright cylindrical blast furnace in an embodiment of the present invention. Stave coolers are used throughout, but FIG. 1 is intended to show that at least three horizontally curved and trapezoidal variations of the stave coolers are needed to better fit the inside contours of the blast furnace.

FIG. 1 represents a blast furnace (BF) 100 in an embodiment of the present invention. BF 100 is vertically cylindrical, with at least three zones, a stack 102 that narrows in diameter at the top, a Belly 104 with essentially vertical walls, and a Bosh 106. Not shown are the Tuyere level and the hearth beneath. So BF 100 here comprises three types of stave coolers, 108, 110, and 112, generally in panels ten feet tall, about forty inches wide, and six inches thick. All have a slight horizontal curvature in them to allow a better fit inside the cylindrical walls.

Stave coolers 108 are about forty inches wide at the top and about forty three inches wide at the bottom to accommodate the cone effect of the stack 102 narrowing in diameter at the top. Stave coolers 110 are about forty three inches wide top and bottom because the top and bottom diameters of Belly 104 are about the same. Stave coolers 112 are about forty three inches wide at the top and about forty inches wide at the bottom to accommodate the inverse cone effect of the Bosh narrowing in diameter at the bottom.

A single blast furnace shell 114 is typically made of two inch carbon steel plate, and provides an outermost blast furnace containment. Its walls and penetrations 116 provide the necessary support on which to hang every stave cooler 108, 110, and 112. The penetrations 116 can be cut onsite from the outside with a gas torch. If access to the inside is possible, the job of cutting penetrations 116 is much easier.

Each stave cooler can typically weigh 3,000 kg, principally consisting of very pure copper casting and associated piping and fittings. Such weight is almost entirely supported by a steel water pipe collection box and stave cooler support (hereinafter, "pipe box") 115 that protrudes from the backside of each stave cooler 108, 110, and 112.

In the top left corner of FIG. 1, a stave cooler 108 is shown in the process of being lifted and installed inside blast furnace shell 114. The object is to lift stave cooler 108 and insert a pipe box 115 through a penetration 116. An adapter plate 117 can then be welded on to secure stave 108 in place. The job of installation is made much easier if a steel lifting plate 118 is attached to a hoist line and is fastened to the hotface of stave cooler 108 using two very long threaded rods or hex-head machine bolts 119. It helps if lifting plate 118 has a horizontal rib that can key into the horizontal ribs and lock on the hotface of stave cooler 108.

These two bolts 119 are long enough to be run completely through pipe box 115 and to be fastened with nuts 120 to a winch line draw plate 121. Such lifting plate 118, bolts 119, nuts 120, and winch line draw plate 121 should already be assembled when the stave cooler 108 is lifted up and dangling on the hoist line. The winch line can be slipped through penetration 116 to draw it out and into place for welding.

All such pieces are reusable, except bolts 119 which get punched in from the outside (after removing nuts 120 and draw plate 121) to fall down to the bottom on the inside. The holes left behind are then plugged up or otherwise filled from the outside. The bolt holes left behind could also be used for thermocouples and wear monitor probes with appropriate packing and sealing.

Since stave coolers 108, 110, and 112 do not all hang the same vertically inside BF 100, their respective pipe boxes 115 must be set at a different angle for each such that all the plumbing exiting from them will be level after installation in the shell 114. Therefore, three variations of pipe box 115 are needed, stave coolers 108 require a pipe box 122, stave coolers 110 require a pipe box 123, and stave coolers 112 require a pipe box 124.

A number of independent loops of MONEL-400, for example, water pipe are cast into every stave cooler 108, 110, and 112. Other embodiments may use copper-nickel instead of MONEL-400. A single group 126 of water inlets and outlets connected internally are routed horizontally out through each respective pipe box 122, 122, and 124. MONEL-400 and copper-nickel water pipe are used instead of ordinary copper tubing in some embodiments because such bonds better to the copper casting being poured and the hot liquid copper will not "burn through" during casting.

A temporary lifting bolt 128 can be fitted into each stave cooler 108, 110, and 112 during installation inside of and on shell 114, e.g., to lift it so lifting plate 118 and bolts 119 can be installed and attached to the hoist line. After it's no longer needed, it can be removed and the inside threaded area plugged. A set of four slip bolts 130 is installed for each stave cooler 108, 110, and 112 from outside shell 114. The four slip bolts 130 are not needed so much to support the weight of each stave cooler 108, 110, and 112 inside shell 114, but are used to hold the stave cooler up against the blast furnace shell. The four slip bolts 130 need to be snug, but should allow for some slippage as will be needed when the stave cooler naturally expands and contracts. Special washers inside or outside, or both, may help this functioning. Once bolts 130 are installed from outside shell 114, a gas-tight cup 132 is welded over the head of each on the outside of shell 114. Lethal carbon monoxide (CO) process gases can leak past otherwise.

Figures 2A, 2B, 2C, 2D:
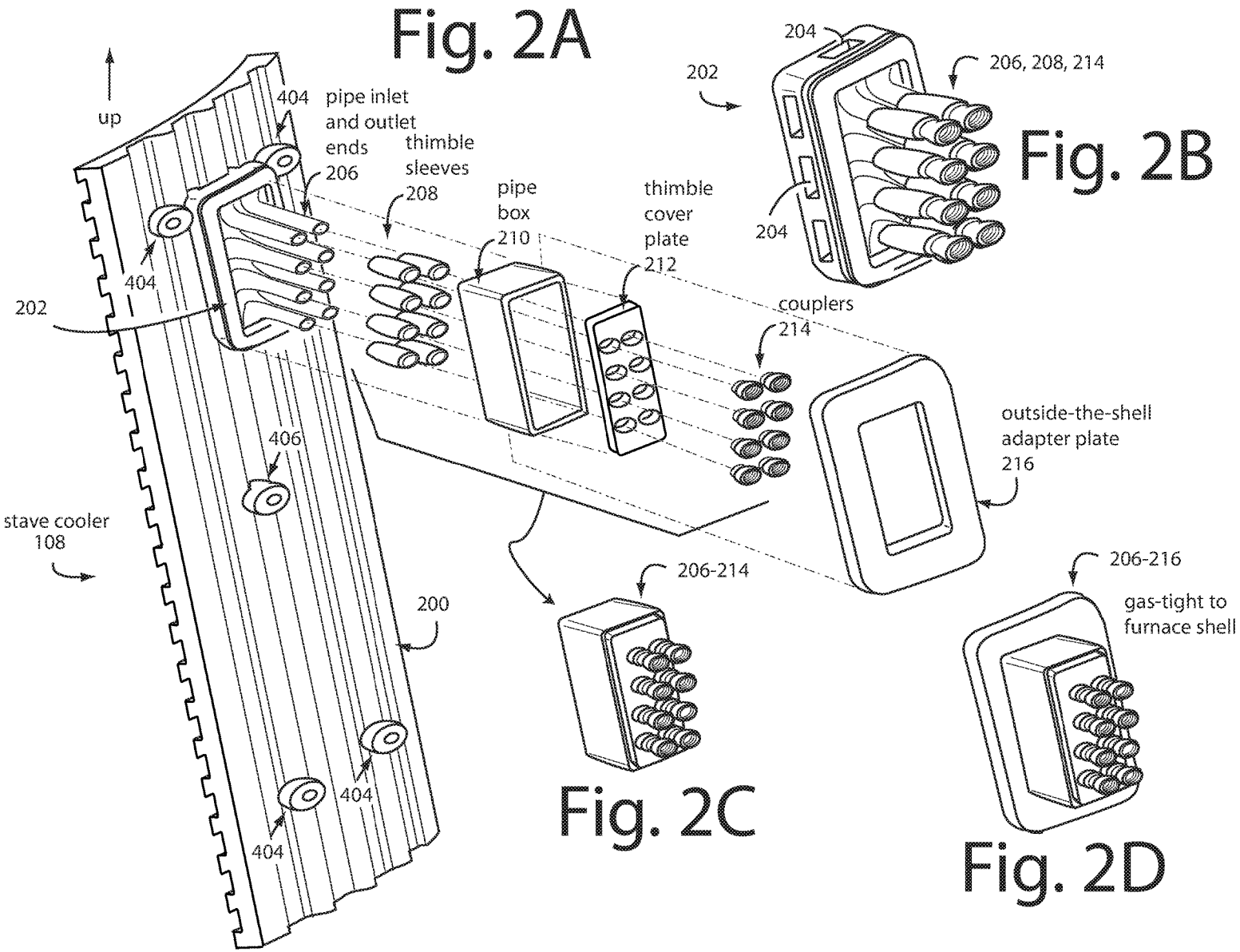
FIG. 2A is an above and left perspective view diagram of a representative stave cooler from the blast furnace of FIG. 1 in an embodiment of the present invention. The stave cooler is shown as it comes finished from copper casting with a steel, perforated frame anchor copper-steel welded and/or copper entrained and embedded flush in the copper casting. Bare water pipe inlet and outlet ends are exposed. These need to be sleeved in gas-tight thimbles and enclosed in a pipe box.
FIG. 2B is a diagram for illustration purposes only of how the perforated frame anchor opens up to pass all the water pipe inlet and outlet ends. Alternative ways of anchoring are obvious. It further shows the thimble sleeves and couplers in place without showing the pipe box, stave casting, and thimble cover plate that would make this view impossible.
FIG. 2C more realistically shows the several water pipe inlet and outlet ends in one group and gas-tight enclosed within the pipe box and thimble cover plate and finished with thimble sleeves and pipe couplers.
FIG. 2D is an outside perspective view diagram of the part of the assembly of FIG. 2C that is exposed and visible outside the blast furnace shell (without showing the shell), and with an outside-the-shell adapter plate that is welded to both the blast furnace shell and the assembly of FIG. 2C. Such weld is also gas-tight and sufficient to enable the pipe box to support the entire weight of the stave cooler inside the blast furnace shell.

FIG. 2A represents a typical stave cooler from BF 100 as it comes finished from copper casting with a steel, perforated frame anchor 202 copper-steel welded and/or copper entrained in openings 204 and embedded flush in a copper casting 200. Alternatively, perforated frame anchor 202 can be made of stainless steel or nickel alloy. Alternatively, 204 may be tabs or protrusions that get themselves locked inside the cast metal. The backside is shown scalped of material to lighten the stave and reduce costs, that may not always work well. In some applications this can be important, e.g., to save money on the copper.

Bare water pipe inlet and outlet ends 206 are exposed. In this embodiment, these are sleeved in gas-tight thimbles 208 and enclosed in a pipe box 210. It is possible to not use sleeves at all. FIG. 2A shows a thimble cover plate 212 that slips over the several thimble sleeves and installs over the water pipe inlet and outlet ends 206. The thimble cover plate 212 is perimeter welded in the factory to the pipe box 210, and welded all around each and all of the thimble sleeves 208 for a gas-tight containment of lethal processes gases that snake around behind stave 108 and into pipe box 210. The several distal ends of the water pipe inlet and outlet ends 206 are here fitted with pipe couplers 214.

Many other obvious ways exist to bring the water pipe inlet and outlet ends 206 out of pipe box 210 and fit them with pipe couplers 214. The point is to keep process gases contained inside while enabling the coolant plumbing connections outside. So the pipe ends themselves or the couplers can be welded to the thimble cover plate 212 when there is no sleeving. The piping includes 2" diameter NPT components in this embodiment.

FIG. 2B is for illustration purposes only. The perforated frame anchor 202 is open in the middle to pass through all the water pipe inlet and outlet ends 206. The thimble sleeves 208 and couplers 214 are seen in place without showing the pipe box, stave casting, and thimble cover plate that would make this view impossible.

FIG. 2C is more realistic. Several water pipe inlet and outlet ends 206 are gathered in one group, and gas-tight enclosed within the pipe box 210 and thimble cover plate 212. Outside, it can be finished, e.g., with thimble sleeves and pipe couplers for hose connections.

FIG. 2D is an outside perspective view diagram of the part of the assembly of FIG. 2C that is exposed and visible outside the blast furnace shell (without showing the shell), and with an outside-the-shell adapter plate that is welded to both the blast furnace shell and the assembly of FIG. 2C. Such weld is also gas-tight and sufficient to enable the pipe box to support the entire weight of the stave cooler inside the blast furnace shell.

A flexible, thermally conductive material suitable for elevated temperature service may be stuffed inside pipe box 210 before it is sealed up. FIGS. 2A-2D do not show any. Such thermally conductive stuffing material enables a circulating coolant in the several water pipe inlet and outlet ends 206 to conduct away heat that would otherwise build up in the steel material enclosure of the pipe box assembly 210, 212.

Inside, not shown, this particular embodiment has four independent loops of MONEL-400 2" Schedule-40 pipe that are cast inside copper stave casting body panel 200, together they constitute a pipe circuit. The only parts of that visible in FIGS. 2A, 2B are the four inlet and four outlet pipe ends 206. In one embodiment, these were fitted with 2" AISI 304 pipe couplings and ASTM A-53 pipe sleeves.

It is important to gather the inlet and outlet pipe ends 126 closely together into one group per stave. Their common exit through the blast furnace shell 114 can then be "protected" by the one pipe box (120,122,124) from venting dangerous lethal process gases and from the mechanical and thermal stresses associated with having to support the 3,000+ kg weight of an installed stave cooler. Here, in this embodiment, the pipe boxes are made of ASTM A-36 carbon steel, but structural steel, or boiler plate steel are also possible.

Embodiments of the present invention do not cast the pipe boxes into the copper stave casting body panel 200. We ourselves tried doing that with unsatisfactory results. Carbon steel components do not bond well to the copper using conventional methods and can pull out and apart in service. For example, see the "manifold 106" in U.S. Pat. No. 10,222,124, issued Mar. 5, 2019. Steel components do not seal well in gas tight connections to the copper using conventional methods and lethal process gases can leak through the copper made porous at the interface while in service. The molten liquid copper during the casting pour cannot be pushed to well-up high enough inside.

A sufficiently strong "manifold" must have the copper casting well up high inside to add the strength needed to support the full weight of the stave cooler.

What makes pushing up the molten copper to well up high inside the "manifold" a bad idea is a so-called shrink-back. The extra thick copper welling up creates hot spots that shrink with cooling so much that the copper will pull off the steel inside.

Supports made of steel can be mechanically locked in by exotic dissimilar metal welding, and/or by entrained liquid copper that passed through and froze inside openings preformed in the steel footer rings.

Figure 3A:
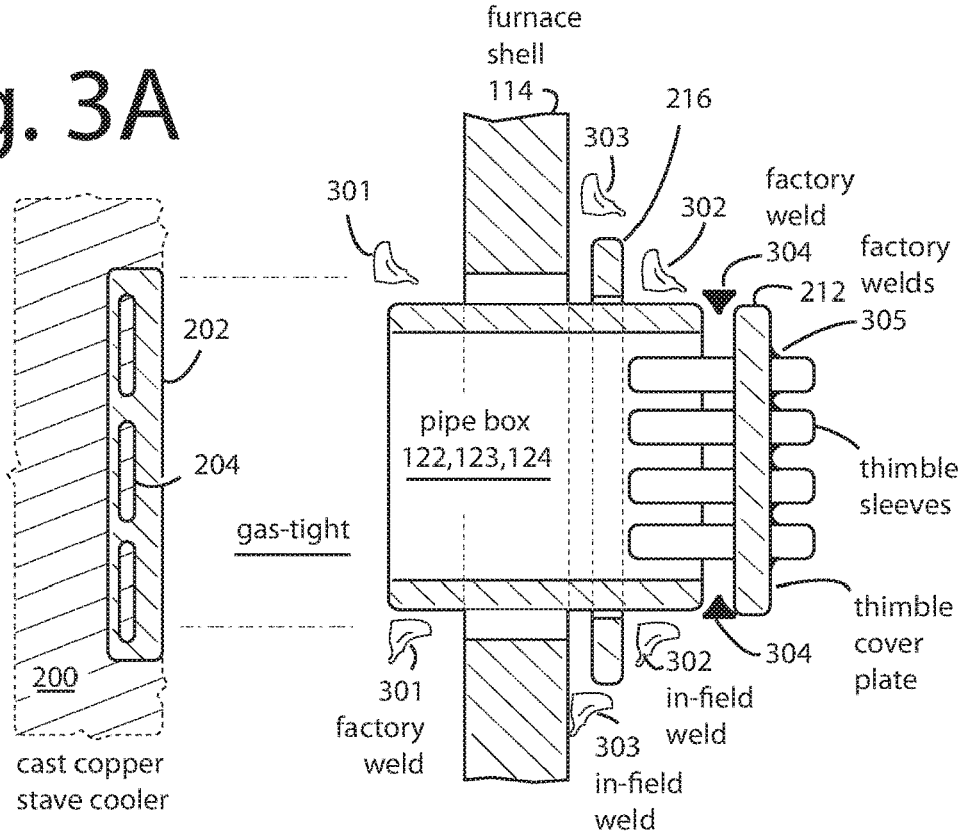
FIGS. 3A and 3B are a cross-sectional view diagram and a perspective diagram that illustrate there is an order and sequence to how the pipe box is welded to the already embedded steel perforated frame anchor after being frozen inside flush of the copper casting and/or welded in place. The pipe inlet and outlet ends are not shown for illustration clarity of the assembles that are shown.
Figure 3B:
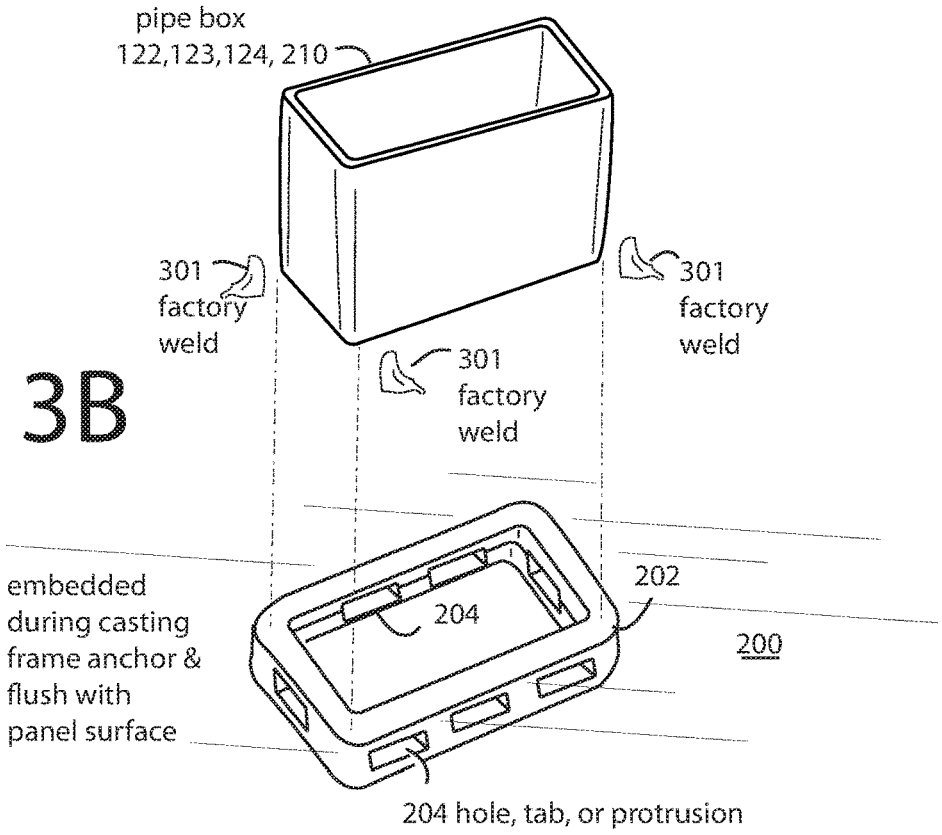

As represented in FIGS. 3A and 3B, embodiments of the present invention cast a structural steel, or boiler plate steel, footing and foundation frame 202 flush inside the copper stave casting body panel 200. Frame 202 surrounds the inlet and outlet pipe ends 126 like a low collar, but only to the surface level of the copper stave casting body panel 200. After casting is complete, the bottom edge of the appropriate steel pipe box 122, 123, 124 is welded in a factory weld 301 to the exposed top face of the steel footing and foundation frame 202. Pipes boxes can easily be 18" tall and 9" wide, hollow inside, and weigh forty-one kg. The welding 301 must be continuous and gas-tight, and the technology to do this is widely available, conventional, and practical to finish in the field.

Extraordinary measures are required to be sure the steel footing and foundation frame 202 stays strong and does not ever separate from the copper stave casting body panel 200. Exotic welding methods must be applied to weld steel to copper. Currently, this can only be done by specially equipped and advanced stave foundries. No practical field method or equipment is available.

Mechanical anchoring methods are used herein to lock the carbon steel footing and foundation frame 202 in place within the copper stave casting body panel 200. Openings 204 are placed in the bottom half of the footing and foundation frame 202 such that fingers of molten copper can flow in and freeze during casting to lock the parts together. No bonding of metals is relied upon by this alternative technology, and so the quality of any bonding achieved need not be all that good. Advantageously, the pipe boxes are excluded from the casting processes, and so are not underfoot.

During construction of BF 100, and the installation of any of stave coolers 108, 110, and 112, the job of hanging each inside in its place is highly simplified by the use of only one pipe box 122, 123, 124. Conventional staves often had four inlets widely separated from their corresponding four outlets wherein each was shielded by its own "protection pipe". Work crews find it much easier while maneuvering the heavy stave cooler to thread through the single pipe box in the blast furnace shell 114.

The stave coolers are lifted up inside blast furnace shell 114 and maneuvered to insert its corresponding pipe box 122, 123, 124 through an appropriate matching penetration. An adapter ring 216 is slipped over and a in-field weld 302 applied. Then a, in-field weld 303. A thimbled cover plate 212 with thimble sleeves is slipped over inlet/outlet pipe ends and welded at the factory with a weld 304 and a weld 305. All welds 301-305 must be continuous and gas-tight in order to contain lethal process gases inside pipe box 122, 123, 124. Fortunately, all welds are simplified by being carbon steel to carbon steel, and so those applied in the field can succeed with conventional equipment.

Returning to FIG. 2, the carbon steel footing and foundation frame 202 is always embedded by casting or solid state welding within the copper casting 200 before it is welded to pipe box 122, 123, 124. FIG. 2 has a duplicate footing and foundation frame 202 shown outside the casting 200 and already welded to the pipe box 122, 123, 124. This is shown here this way for illustration only purposes.

The steel footing and foundation frame 202, and a matching pipe box, could be in the form of a ring and a cylinder in order to facilitate friction welding by spinning carbon steel footing and foundation frame 202 under pressure into the casting 200.

The point is to show openings 204 for copper finger entraining exist all around the bottom lower perimeter of footing and foundation frame 202.

Once each stave cooler 108, 110, and 112 is raised and hung inside shell 114, and its pipe box 122, 123, 124 is pushed all the way through, an adapter plate 210 is slipped over outside and welded on all around for a gas-tight seal. The inside opening dimensions of adapter plate 210 can be tightly controlled economically. More so than trying to get the pipe box penetrations in shell 114 to locate and fit concisely. The adapter plate 210 is a crutch to make installation easier, the pipe boxes themselves can, of course, be directly welded to the pipe box penetrations in shell 114, given the gaps all around are not too wide.

Since each stave cooler 108, 110, and 112 here is made from cast copper, its hot-face will wear rapidly in service if not provided with a protection barrier, layer or liner. Ordinarily this will be common refractory brick walls erected as the inner liners of BF 100 and cooled by stave coolers 108, 110, and 112. Bricks can require some sort of horizontal ribs and grooves with which the bricks can be inserted and retained for a twenty year campaign life.

Stave coolers made of copper need to have a wear resistant barrier installed on their hotfaces. For example, horizontal rows of refractory bricks made of silicon carbide or graphite can be stacked in front of or inserted by various means into an appropriately contoured hotface. The key benefits of StarCeram® S Sintered Silicon Carbide (SSiC) are advertised commercially to include excellent chemical resistance, very high strength, corrosion resistance up to very high application temperatures, excellent mechanical high temperature properties, very good thermal shock resistance, low thermal expansion, very high thermal conductivity, high wear resistance, very high hardness, semiconductor properties. All good things for a stave cooler in a blast furnace.

Simple "bricks" or blocks of cast iron are also expected to function well.

An alternative to bricks is any refractory or shotcrete, which is similar to gunite and is a refractory that is blown onto the hotfaces of stave coolers through high pressure concrete hoses and nozzles. Minerals Technologies Inc. (MiNTEQ) of Bethlehem, Pa., is a commercial producer of shotcrete for blast furnaces. Its rapid installation rates bring down costs and total refractory installation time, they are low-rebound and reduce total consumption, and they are superior refractoriness that increase blast furnace life, and improve fuel efficiency.

A variety of SUPERSHOT™ products are sold worldwide for Blast furnace operations. SUPERSHOT™ AR material suits mid-stack to upper-stack re-linings and repairs. It has excellent abrasion resistance at lower temperatures. Sixty percent alumina silica, low cement bonded shotcrete. Such does not require high-firing temperatures to develop its physical properties and abrasion resistance. SUPERSHOT™ SC15 is 72% alumina silica, 15% silicon carbine with ultra-low cement binder. It is high density, high thermal conductivity, low porosity shotcrete capable of rapid dry out. SUPERSHOT™ BL shotcrete material is suited for the thermal protection of Belly Linings during blow-in. The same shotcrete equipment can be used, with no change over to gunning material and batch guns. Rapid installation rates of over eight tons/hour are possible.

FIGS. 3A and 3B are a cross-sectional view diagram and a perspective diagram that illustrate there is an order and sequence to how the pipe box is welded to the already embedded steel perforated frame anchor after being frozen inside flush of the copper casting and/or welded in place. The pipe inlet and outlet ends are not shown for illustration clarity of the assembles that are shown.

Figures 4A, 4B:
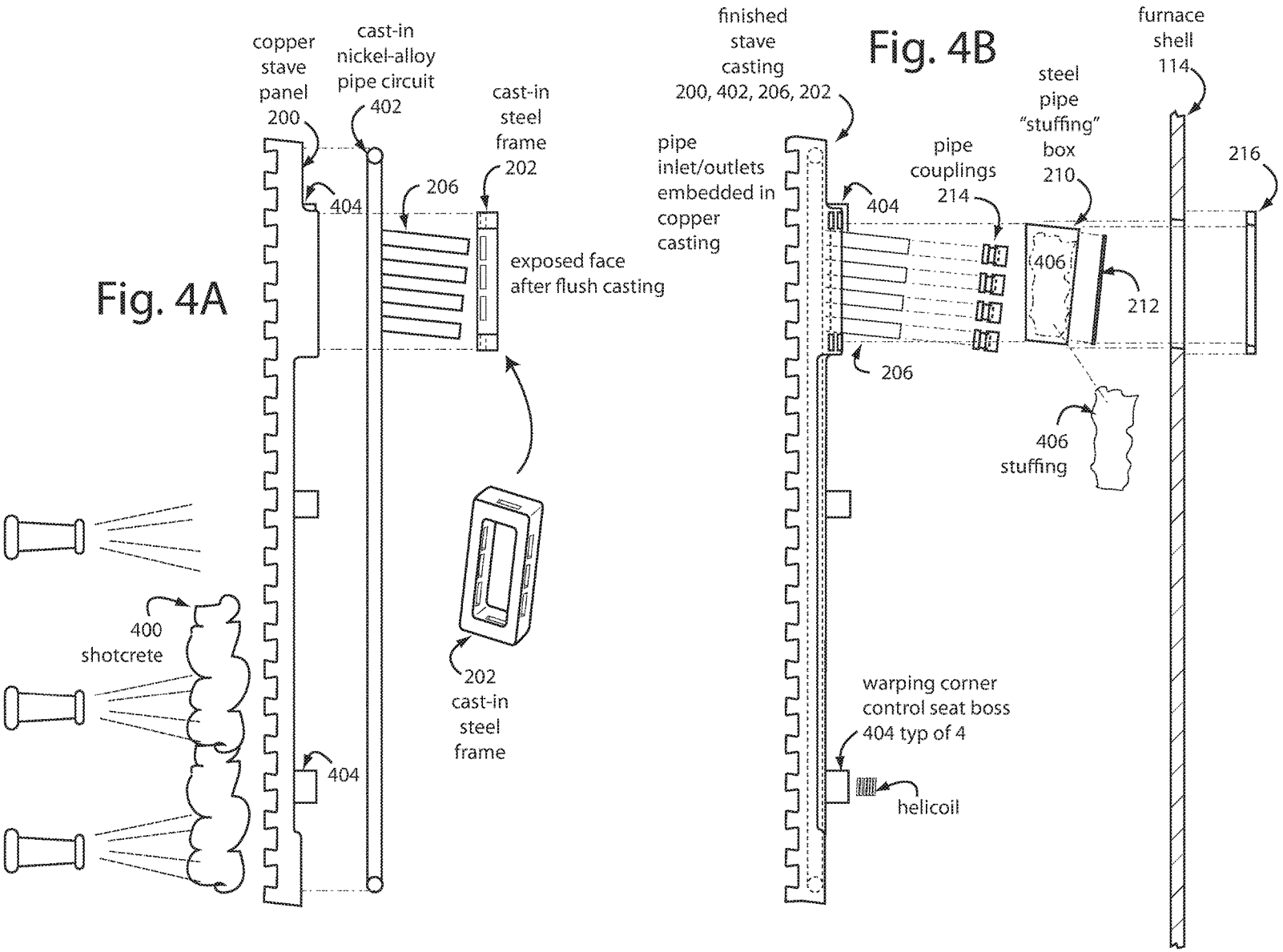
FIG. 4A is a cross sectional view diagram of a stave cooler embodiment of the present invention in exploded assembly view before copper casting, such stave cooler is similar to those of FIGS. 1 and 2A, except that the hotface here has been horizontally grooved to retain shotcrete blown on through hoses and nozzles. Here are represented the copper casting of the stave itself, the pipe circuit that goes into the casting, and the perforated frame anchor that also goes into the casting and that is left with an exposed face after being set flush in the casting.
FIG. 4B is a cross sectional view diagram of a finished stave casting of FIG. 4A.

FIG. 4A represents a stave cooler 108 in an embodiment of the present invention before copper casting, such stave cooler is similar to those of FIGS. 1 and 2A, except that the hotface here has been horizontally grooved to retain a shotcrete 400 blown on through hoses and nozzles. Here are represented a copper casting 200 of the stave itself, a pipe circuit 402 that goes into the casting 200, and the perforated frame anchor 202 that also goes into the casting 200 and that is left with an exposed face 403 after being set flush in the casting.

FIG. 4B shows the finished stave casting 108 of FIG. 4A.

Figure 4C:
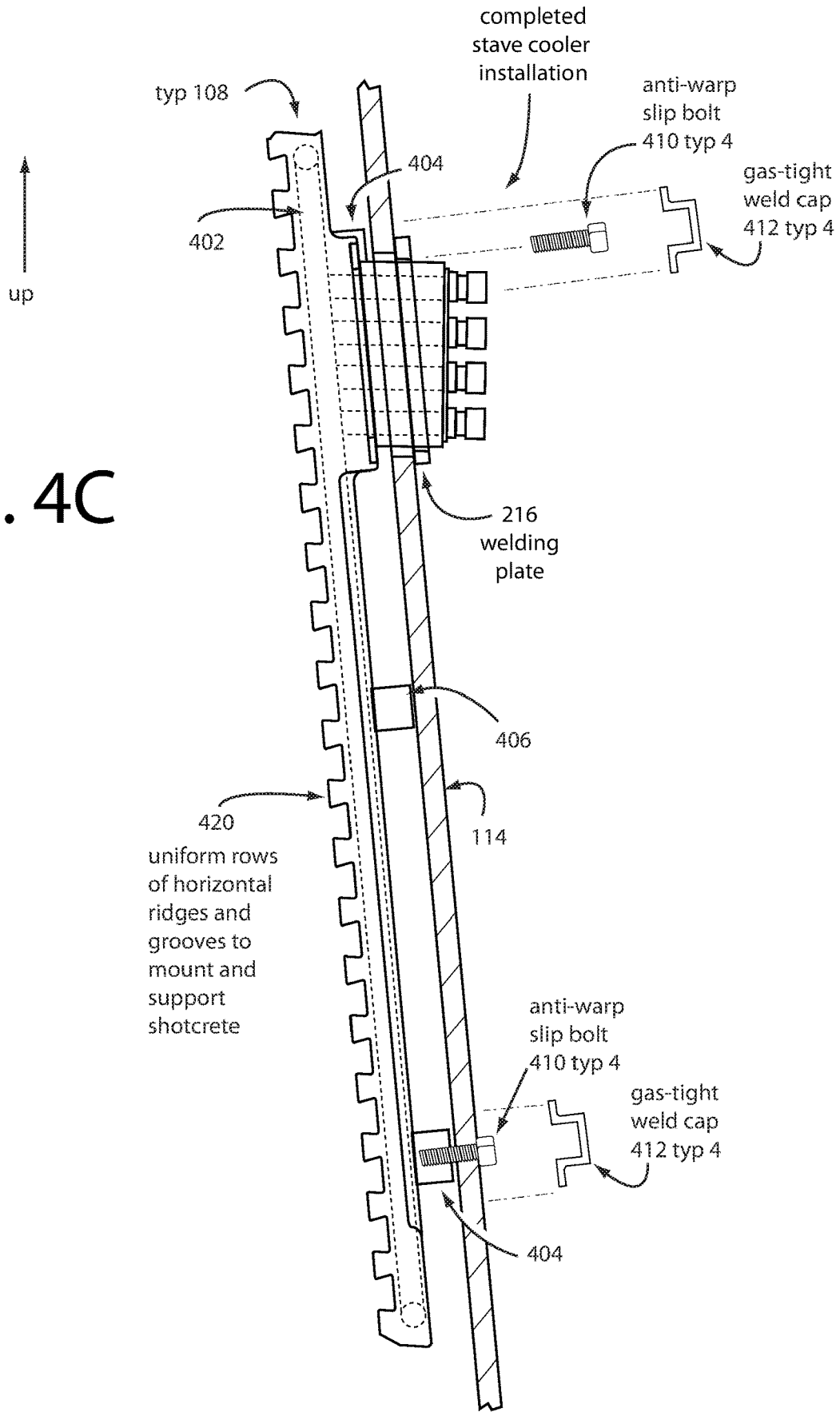
FIG. 4C is a cross sectional view diagram of the finished stave casting of FIG. 4B and how the stave assembles further and mounts to the blast furnace shell to hang on by the pipe "stuffing" box. Bolts in the four corners are used for the initial installation of the stave cooler, and to hold the stave cooler in place against the inside of the blast furnace shell.

FIG. 4C assembles the finished stave casting 128 of FIG. 4B further to mount to the blast furnace shell 114 to hang on by the pipe "stuffing" box 210. In FIGS. 4B and 4C, slip bolts 404 in the four corners are threaded into helicoil insertable threads or stainless steel cast-in insert to help keep the stave cooler 108 tight against the blast furnace shell. A stuffing material 406 is packed, poured, cast, or otherwise used to fill the insides of pipe "stuffing" box 210 so heat can be carried away by the coolants circulating through pipe inlets/outlets 206. Suitable materials for this purpose abound, but they must be flexible and able to tolerate high temperatures.

Figure 5A:
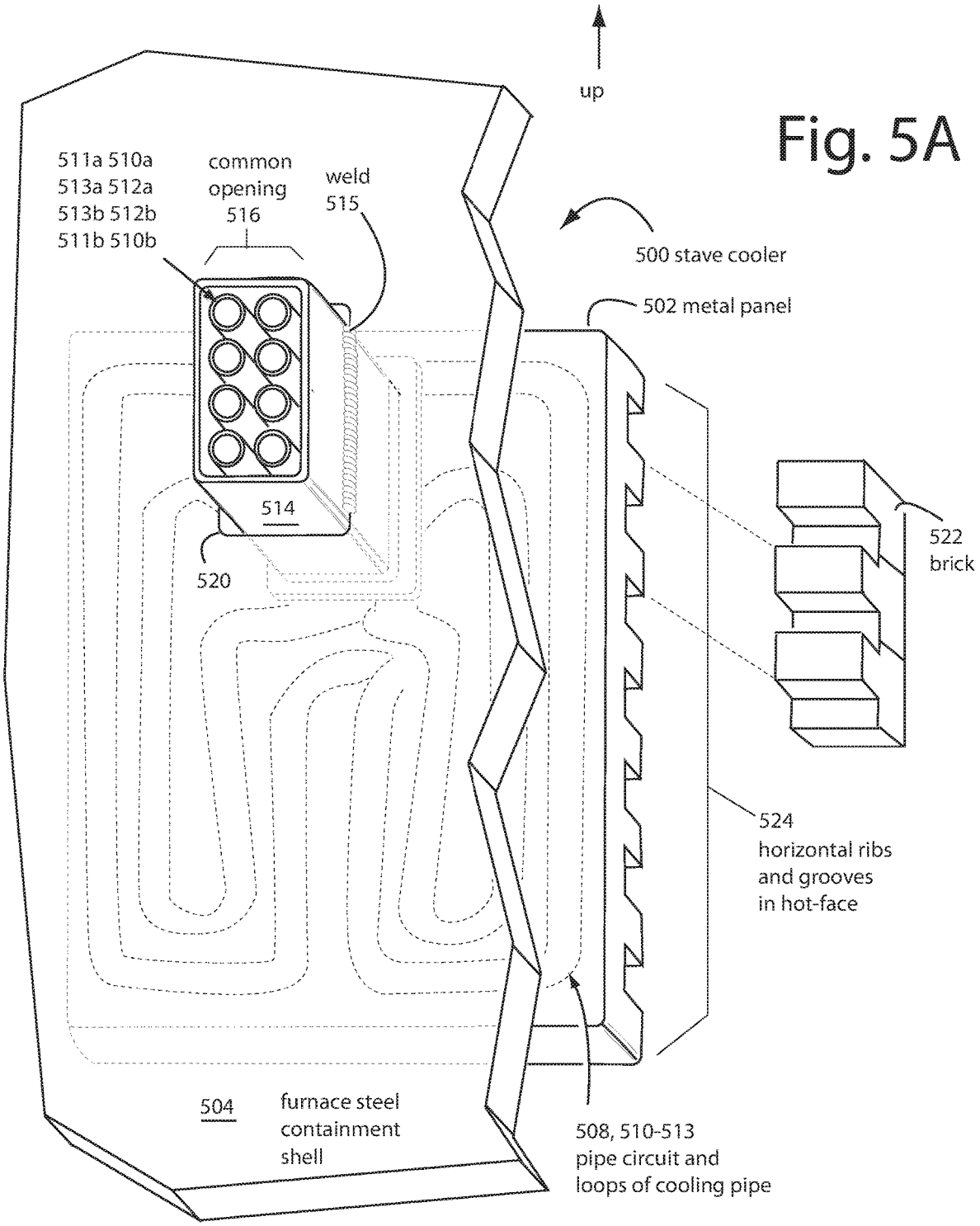
FIG. 5A is a perspective view diagram of a stave cooler with a single pipe box hung on and supported by a single matching penetration for it in a blast furnace shell. Horizontal grooves are provided to retain refractory brick. The pipe box can be welded to the blast furnace shell in a continuous gas-tight seal if the gaps inside the penetration are minimal, otherwise an adapter plate will be needed.
Figure 5B:
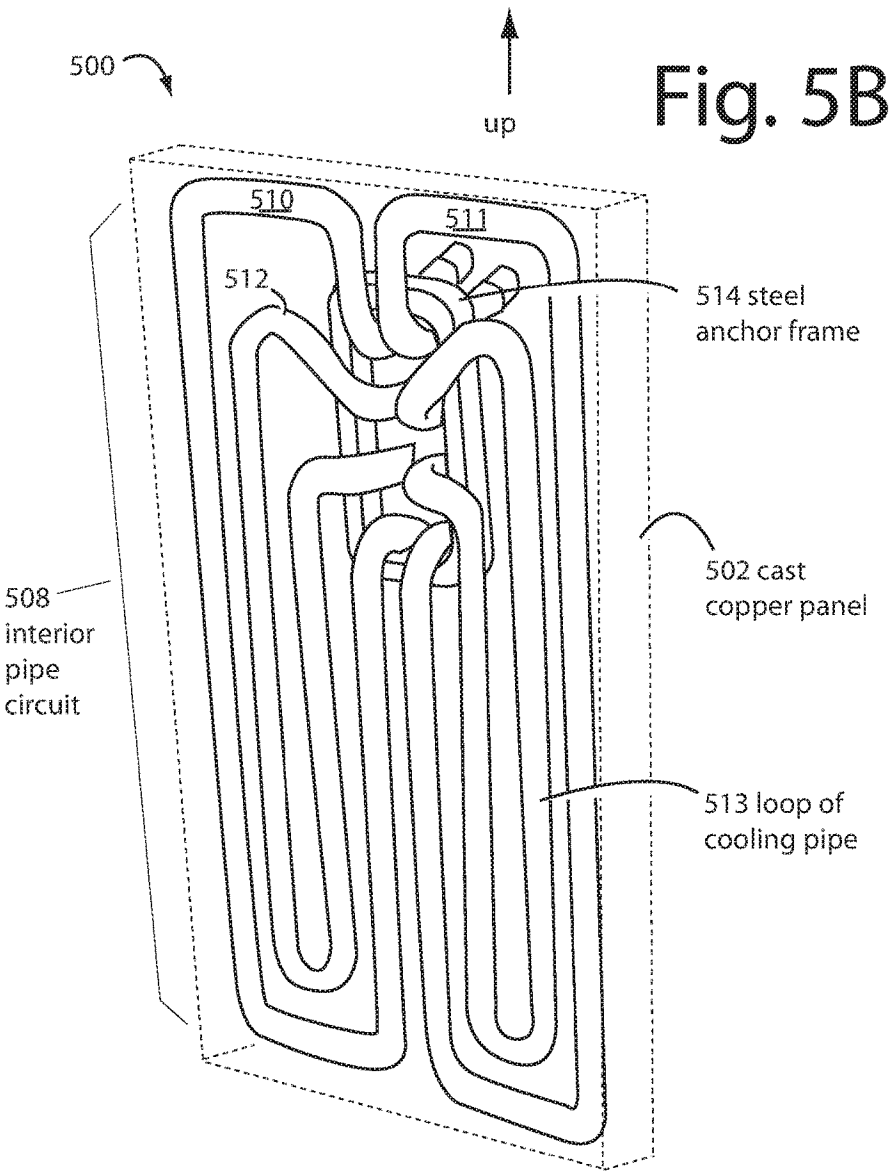
FIGS. 5B and 5C are side view and perspective view diagrams of the pipe circuit internal to the stave cooler panel of FIG. 5A.
Figure 5C:
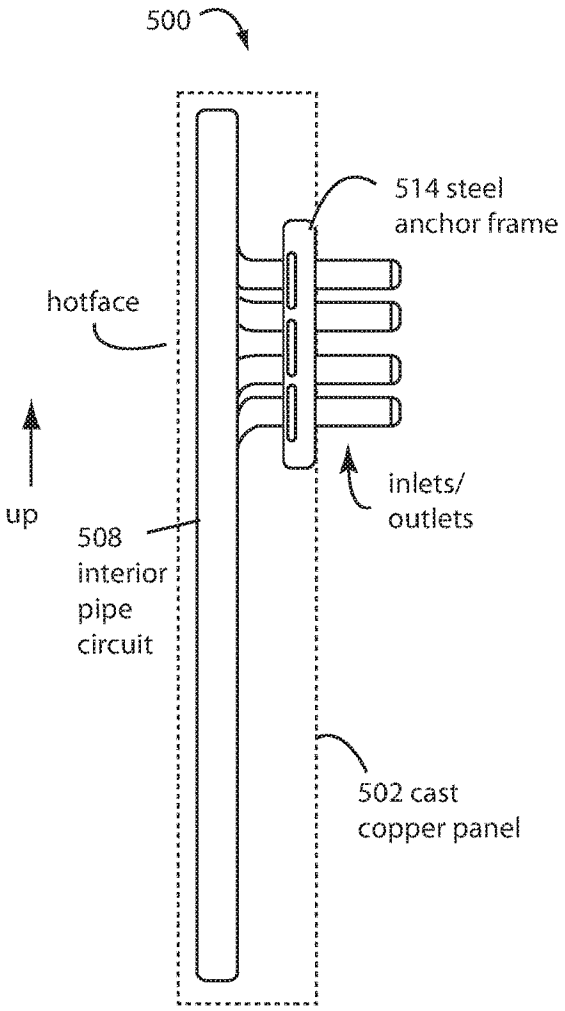

FIG. 5A represents a stave cooler 500 and metal panel 502 installed inside and onto a blast furnace shell 504. A pipe circuit 508 is fully disposed inside metal panel 502 and includes four loops of piping 510-513. These respectively are brought out together in a single group as inlet/outlet ends 510*a*, 510*b*, 511*a*, 511*b*, 512*a*, 512*b*, 513*a*, and 513*b*. All these pass through inside a single pipe box 514. Such fits inside an is hung on and supported by a single matching penetration 520 provided for it in blast furnace shell 504. Horizontal grooves 524 are provided to retain refractory brick or shotcrete. The pipe box 514 can be welded directly to the blast furnace shell 504, as shown here, in a continuous gas-tight seal if the gaps inside the penetration 520 are minimal, otherwise an adapter plate will be needed. FIGS. 5B and 5C represent how pipe circuit 508 lays flat internal to the stave cooler panel 502 of FIG. 5A. These FIGS. 5B and 5C clearly show a steel anchor frame 514 that is cast flush into one face of the stave cooler panel 502 in a ring around all the single group of inlet/outlet ends 510*a*, 510*b*, 511*a*, 511*b*, 512*a*, 512*b*, 513*a*, and 513*b*.

Alternatively, steel anchor frame 514 is welded in with solid state welding technology to achieve very strong, gas-tight bonds with the copper casting. Solid-state welding is defined as a joining process without any liquid or vapor phase, with the use of pressure, and with or without increased temperature. Solid-state welding generally refers to a coalescence that results from the intense application of pressure alone or a combination of heat and pressure. When heat is used, the temperature in the process is kept below the melting point of the metals being welded. No filler metal is used. Representative welding processes include: diffusion welding where two surfaces are held together under pressure at an elevated temperature and the parts coalesce by solid-state diffusion; friction welding where coalescence is achieved by the heat of friction between two surfaces; and, ultrasonic welding where moderate pressure is applied between two parts and an oscillating motion at ultrasonic frequencies is used in a direction parallel to the contacting surfaces. The combination of normal and vibratory forces results in shear stresses intense enough to push aside surface films and produce atomic bonding of the two surfaces.

Figure 6B:
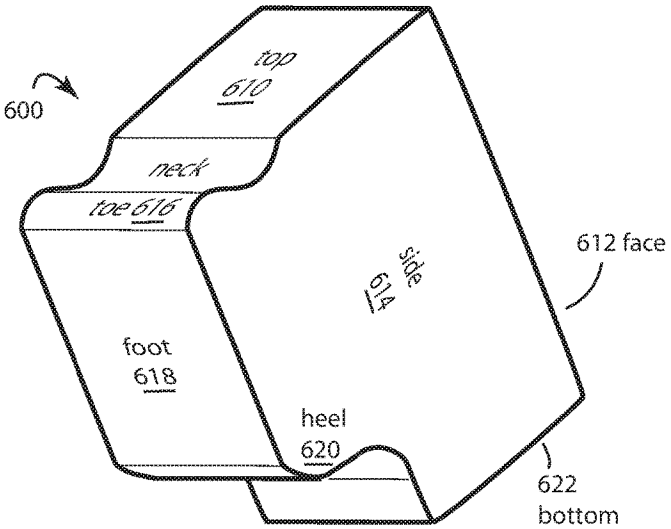
FIGS. 6A and 6B are perspective view diagrams of the horizontal ribbing, and channeling that can be machined or molded into the hotface of any stave cooler herein to retain the brick of FIG. 6B.
Figure 6A:
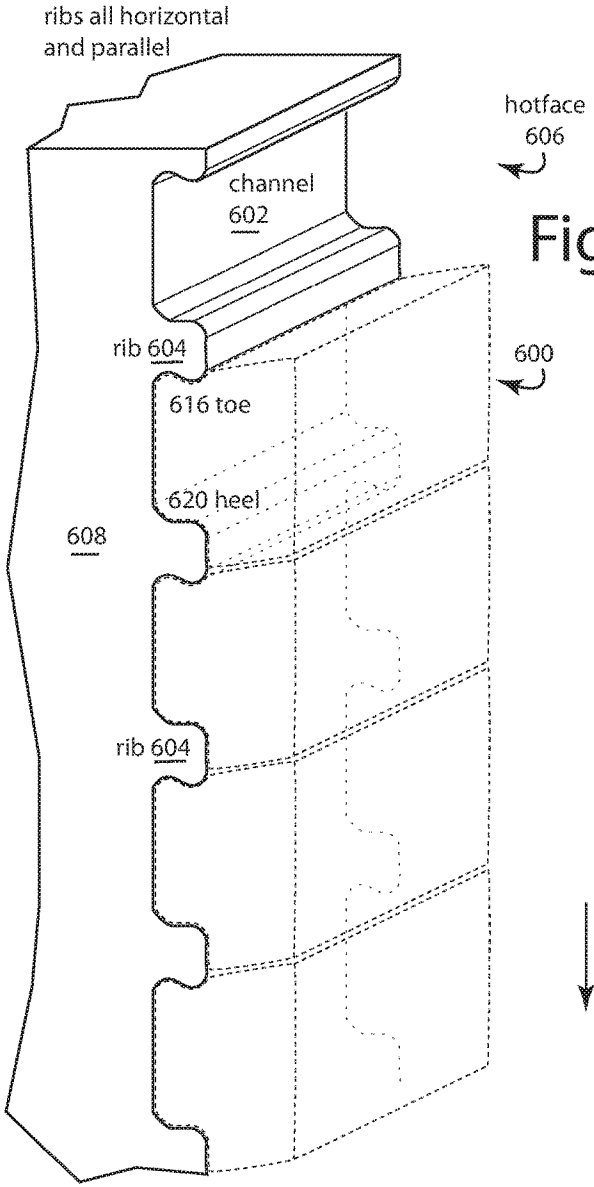

FIGS. 6A and 6B represent a refractory brick 600 pressed into a shape that can be locked into or retained in horizontal channels 602 between parallel ribs 604 in the hotface 606 of a copper stave cooler 608. Brick 600 has a flat top 610, a flat face 612, flat parallel sides 614, a toe 616, a foot 618, a rounded heel 620, and a flat bottom 622. The general arrangement is such that the ribs must be horizontal and vertical to one another so the bricks can be properly retained in earth's gravity. Ideally, gravity assists in the retention. The internal process flow of materials inside BF 100 is generally down, however it is highly wearing, e.g., abrasive, adhesive, erosive, and corrosive. Not to mention hot enough to melt or vaporize most materials. Water coming into contact with it can be powerfully explosive. See our parent application to this one about RICH GLYCOL, US Published Patent Application 2018-0245171 on Aug. 30, 2018.

The life and performance of bricks 600 will be severely curtailed if they do not stay in intimate contact with stave cooler hotface 606 to receive cooling. Gaps, cracks, and spalling can cause excessive heating. It helps if bricks 600 form a tight enough complete horizontal ring row around the inside of BF 100 that they will swell and expand side-to-side enough to press the feet 618 harder into channels 602. A proper selection of materials for brick 600 is therefore required to get an appropriate amount of expansion without crushing or cracking.

Figure 7:
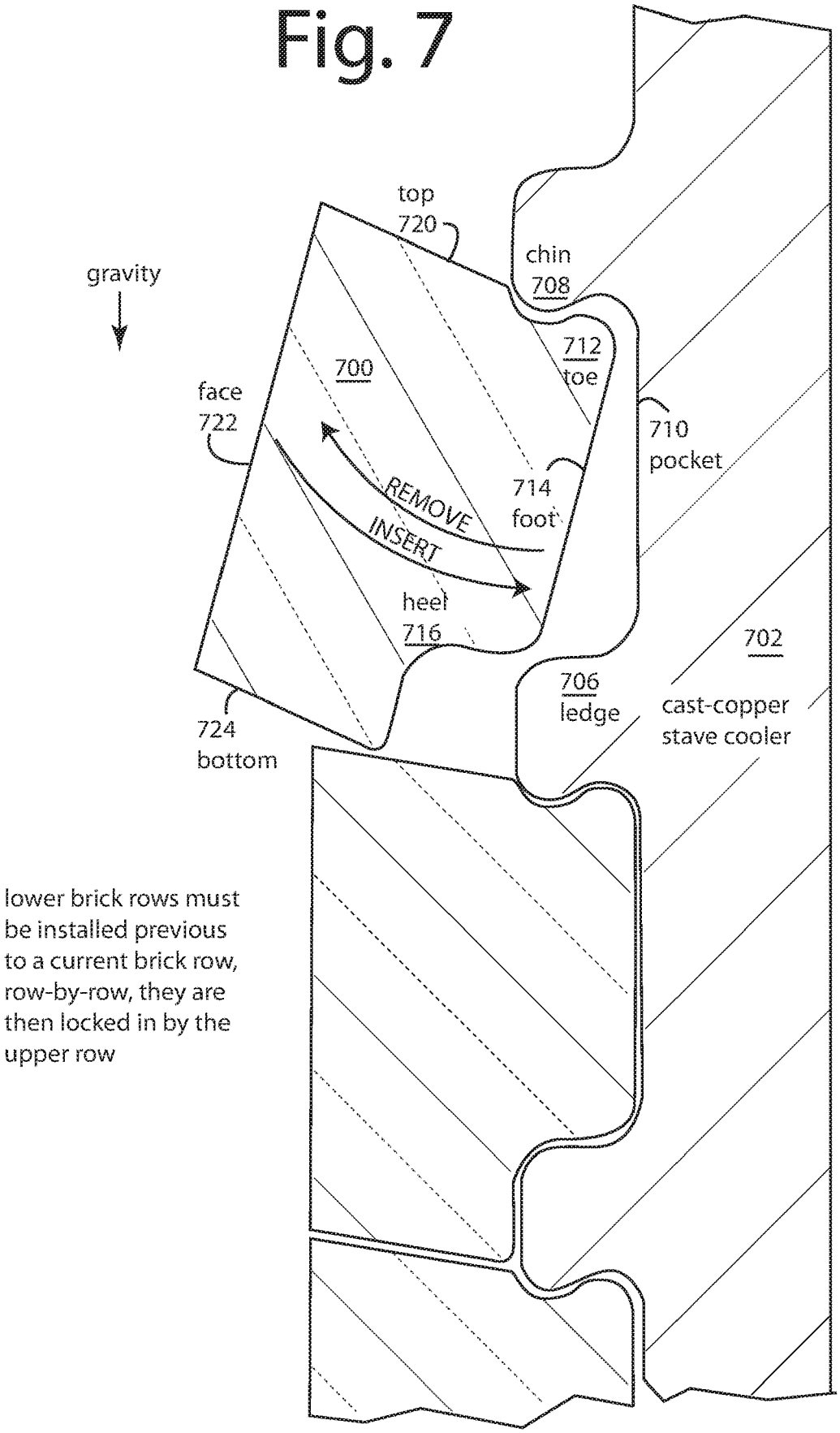
FIG. 7 is a cross sectional diagram of a particular variety of horizontal ribbing, and channeling that can be machined or molded into the hotface of any stave cooler herein to retain a form of gravity like that of FIG. 6B.

FIG. 7 represents a rotate-in-to-lock refractory brick 700. Such are press molded to rather tight dimensional tolerances using silicon carbide or graphite. For example, ±0.0625 inches. We described these in our parent applications to this one as early as 2009. These rotate-in-to-lock refractory bricks 700 require a matching contoured hotface on a copper stave cooler 702. Regular rows of ledges 706 with chins 708 span down over a flat pocket 710 to the next ledge 706 below. The matching bricks 700 include a toe 712 that tucks under each chin 708 and is rotated down with a foot 714 into the matching pocket 710 until a heel 716 settles onto the ledge 706. The brick 700 has a flat top 720, a slightly horizontally concave face 722, and a flat bottom 724. A typical brick 700 is about a cubic foot in volume.

The rotate-in-to-lock refractory brick 700 will not function correctly if not used a correct relative orientation to earth's gravity. FIG. 7 shows the correct relative orientation to earth's gravity with the "gravity" arrow pointing down.

Bricks 700 must be installed in complete horizontal ring rows around the interior of BF 100 before proceeding to a next upper row. Any brick installed in a row above would prevent the top 720 from rotating up because it would contact and be stopped by the bottom 724 of the brick above.

Figure 8:
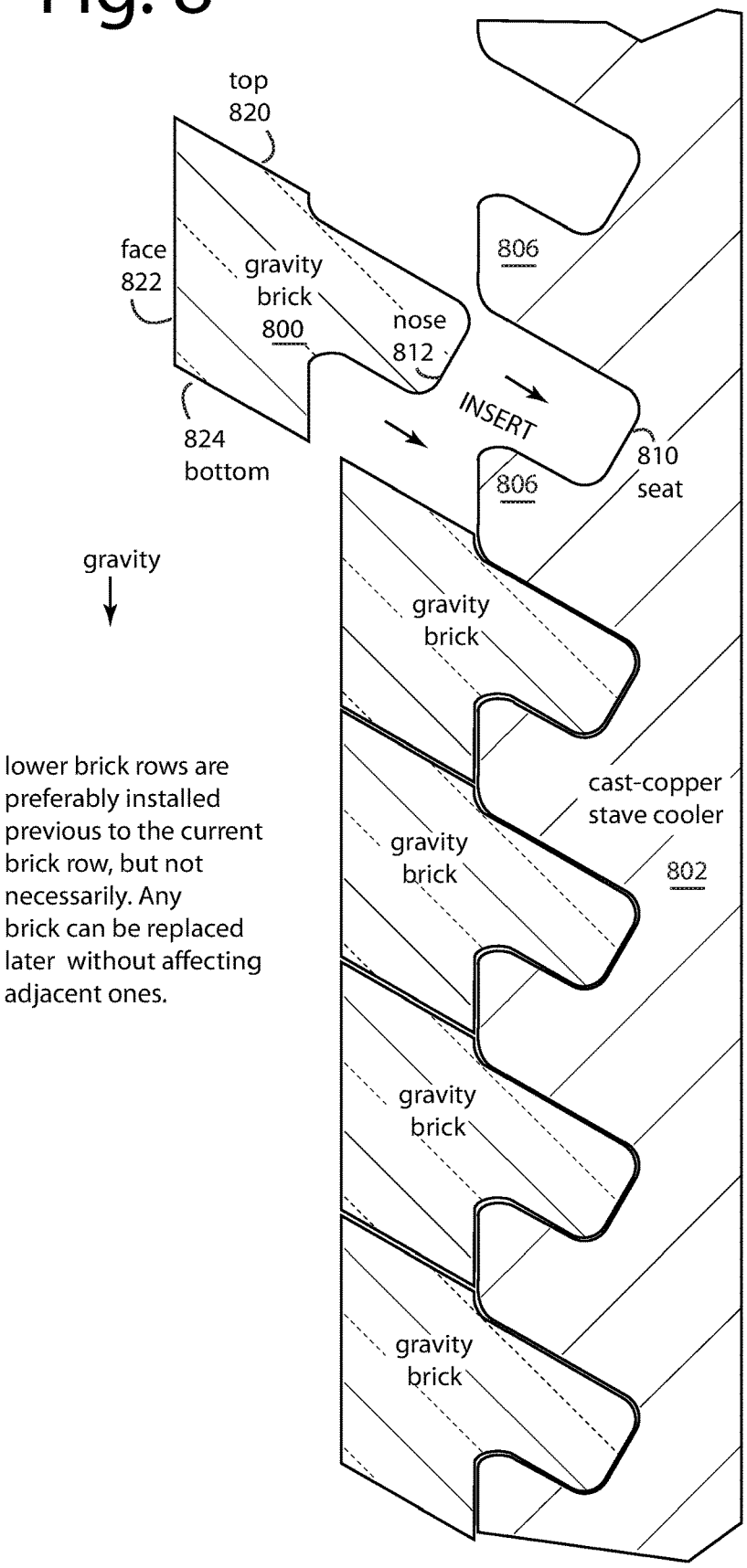
FIG. 8 is a cross sectional diagram of a further particular variety of horizontal ribbing, and channeling that can be machined or molded into the hotface of any stave cooler herein to retain a form of gravity like that of FIG. 6B.

FIG. 8 represents a refractory "gravity" brick 800. Such are molded to ordinary dimensional tolerances using silicon carbide or graphite. These refractory gravity bricks 800 also require a matching contoured hotface on a copper stave cooler 802. Regular rows of upturned ribs 806 span down over a flat seat 810 to the next rib 806 below. The matching bricks 800 include a nose 812 that inserts into each seat 810 until it hits the seat's bottom. The brick 800 has a stepped top 820, a slightly horizontally concave face 822, and a flat bottom 824. A typical brick 800 is about a cubic foot in volume.

The refractory gravity brick 800 will function best if used in a relative orientation to earth's gravity that helps it constantly press its nose 812 deeper into the matching seat 810 as it swells, ages, deteriorates, and shifts over extended periods of operational time. FIG. 8 shows an acceptable relative orientation to earth's gravity with the "gravity" arrow pointing down.

Bricks 800 are preferred to be installed in complete horizontal ring rows around the interior of BF 100 before proceeding to a next upper row. Any brick 800 installed adjacent to any other brick 800 will not prevent the removal of a damaged brick nor the insertion of a new brick thanks to the favorable geometries.

"Bricks" made of cast iron could be shaped like bricks 700 and 800 and be usefully applied.

The weight of every brick 700 or 800 is pretty much carried by their respective stave coolers 702 and 802 because they each fully rest on the horizontal rows of ledges 706 and upturned ribs 806. This means that wear that thins the bricks from their faces can be allowed to continue years longer because the bricks don't have to support any brickwork above. Sudden collapse is not a problem.

Cast copper furnace-block coolers with fused-in copper-nickel (CuNi) pipe embodiments of the present invention for pyrometallurgical furnaces improve over prior furnace-block coolers. The improvements herein include a widespread, continuous metallurgical bonding and fusing of a concentric diffusion interface between the CuNi alloy coolant pipes and the surrounding Cu casting. The fusion bonding is never more than only slightly incomplete over its entire surface area. As a result, the thermal conductivity through the concentric diffusion interface is very high and about equal to the bulk CuNi material. Operational thermal stresses at the concentric diffusion interface are kept inbounds of shear force limits by including a thick, intrinsic cast copper thermal buffer solidified between the hot face and the front-facing CuNi alloy coolant pipes.

Such thermal buffers are typically about 25-32 millimeters thick if the hot face is patterned, and about 38-mm if not. Such thicknesses do not introduce so much bulk material thermal resistance as to allow the hot face to rise above 450° C. during normal operation. Nor can the thermal buffer be much thinner than this as that would reduce its heat spreading effects and cause asymmetric heating inside the CuNi alloy coolant pipes and consequential coolant boiling.

Such thermal buffer's geometric conditions are verified as appropriate, before foundry casting, by Computational Fluid Dynamics and Finite Element Analysis (CFD/FEA) tools, and a 3D-CAD model of the furnace-block cooler.

Casting conditions are overall to result in all but slight and unclustered portions (<15% of total) of the outside surface area of the CuNi alloy coolant pipes metallurgically fusing at their concentric diffusion interface with the solidified casting. Years of experience and testing has led the present inventor to accept that "slight and unclustered portions (<15% of total)" can be dismissed in quality control without much ill effect in the service life of the furnace-block coolers.

Such years of experience and testing has also led the present inventor to understand as a rule-of-thumb that when the hot face rises above 450° C. during operation, unacceptable levels of thermal shear forces will develop at the concentric diffusion interface. And if oxygen is present, the hot face will oxidize and flake. Furnace operators are universally provided with temperature measurements and the means to dial back the heat.

Figure 9:
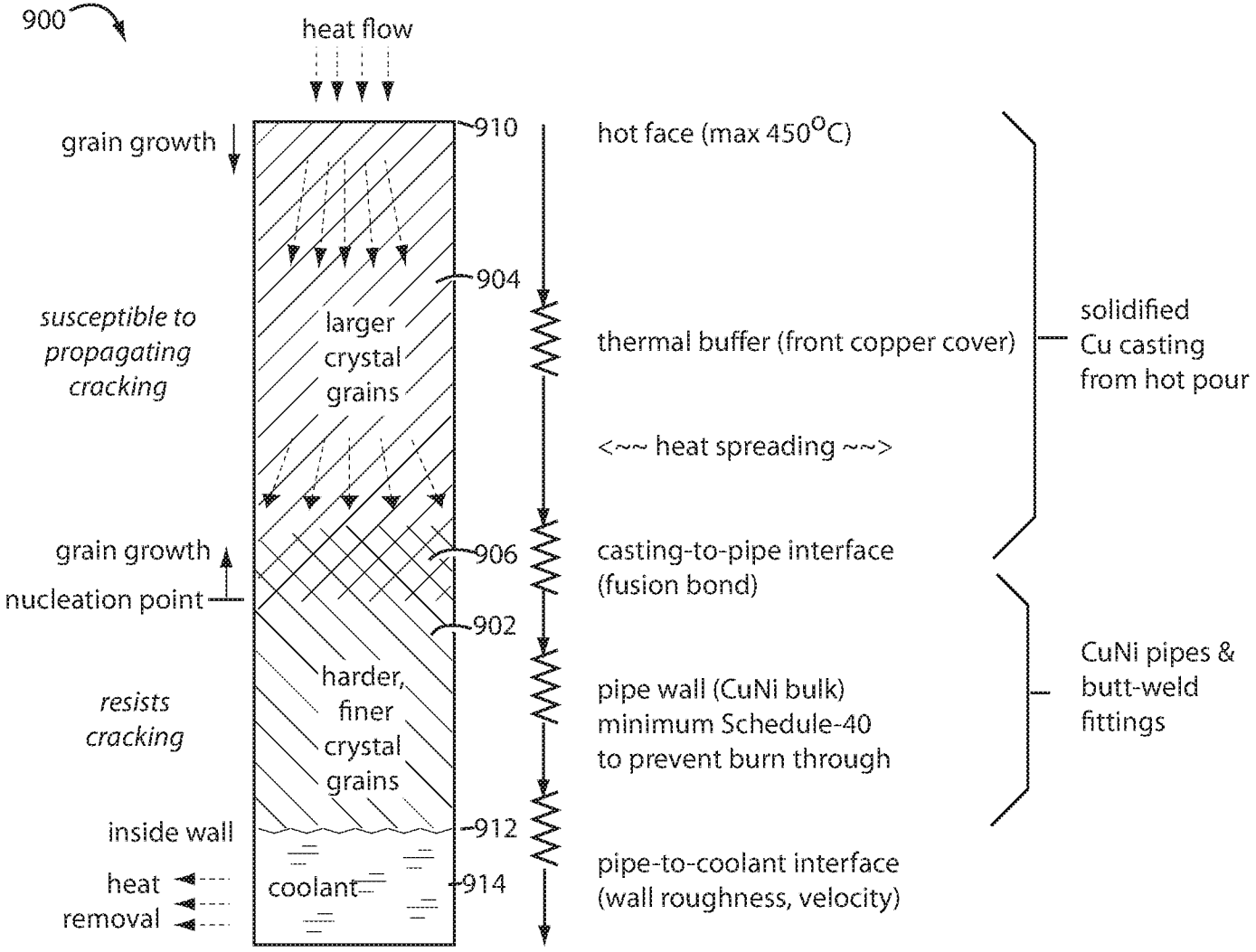
FIG. 9 is a schematic diagram representing a path of thermal conductivity in a core section of an cast copper furnace-block cooler and fused-in CuNi alloy coolant pipe embodiment of the present invention. The path proceeds from a hot face, through the bulk material of a thermal buffer, across a bonded and metallurgically fused interface between a copper casting and a CuNi alloy coolant pipe, and then through the pipe itself into a coolant circulating with a velocity as high as 4.0 meters per second.

FIG. 9 schematically represents a cast copper furnace-block cooler 900 with copper-nickel (CuNi) pipes 902 fused inside a surrounding copper casting and a front-facing thermal buffer 904 that improves over conventional cast copper furnace-block coolers. A metallurgical bonding and fusing of a pipe-to-casting concentric diffusion interface 906 between the CuNi alloy coolant pipe 902 and the Cu casting and thermal buffer 904 is only slightly incomplete over its entire surface area.

In prior work, the Present Inventor taught that "ASTM Schedule-40 pipe, or thinner, can therefore be used for the UNS-type C71500 copper-nickel alloy pipe coils." This turned out not to be true in practice. The CuNi alloy coolant pipe used herein cannot have a wall thickness thinner than ASTM Schedule-40 because burn-through of the walls during casting is all too easy without cooling. And cooling is strictly prohibited herein because such seriously interferes with crystal grain formation across the pipe-to-casting concentric diffusion interface 106. In order words, the pipe will not form proper metallurgical bonds with the casting.

The thermal buffer 904 distributes and moderates an incoming heat flow from a hot face 910 and spreads the heat flow across a span of multiple CuNi alloy coolant pipes 902. The intervening thermal resistance must not be so great as to allow any part of the hot face to exceed 450° C., as determined in computer modelling. Nor should the thermal buffer 904 be fabricated so lightly as to allow asymmetric heating on an inside 912 of the CuNi alloy coolant pipes 902 and consequential film boiling of a coolant 914. After years of design and implementation, the average thermal buffer is typically about 25-32 millimeters thick if the hot face is patterned, and about 38-mm if not. Such patterning usually comprises ridges, grooves, pocket, etc., to retain bricks and other refractory.

CFD/FEA computer modelling is used to verify that the inside wall temperature of the CuNi alloy coolant pipes 102 in operation will not exceed (1) a temperature expected to cause film boiling, or (2) chemical degradation of glycol or other cooling media.

Alternative embodiments of the present invention include weld overlays or calorization of the hot face with aluminum as a final step in manufacturing to protect the furnace-block coolers from wear, abrasion, corrosion, and burn through.

The operational temperature limits are verifiable and predictable as being inbounds from a 3D-CAD model of the furnace-block cooler before their casting in a foundry, e.g., using Computational Fluid Dynamics (CFD) and/or Finite Element Analysis (FEA) tools. For example, it can be predicted, given a starting thickness dimension for the thermal buffer, that the hot face will not operate above 450° C. and that there is enough extra material provided to account for predictable wear and corrosion. Casting conditions are herein to result in all but slight, unclustered portions (<15% of total) of the outside surface area and concentric diffusion interface 106 of the CuNi alloy coolant pipes metallurgically fusing and thus able to provide a good thermally conductive bridge in the concentric diffusion interface.

The surrounding pipe-to-casting concentric diffusion interface 906 is a metal alloy diffusion that bridges a thickness of about 100-micrometers between an inner base metal in the CuNi material unaffected by heat, and into the solidified casting. A heat affected zone (HAZ) within concentric diffusion interface 906 comprises a tempered, a partially transformed, a recrystallized, and a grain-growth nucleation zone. Outside from these is a solid-liquid boundary into a fused zone (FZ) of solidified pure copper.

If the CuNi material in the CuNi alloy coolant pipes 902 that is unaffected by heat is an alloy 67.5% Cu and 32.5% Ni, the surrounding concentric diffusion interface 106 will continuously transition through alloys (e.g., 79.4% Cu and 20.6% Ni, 90.8% Cu and 9.2% Ni, 97% Cu and 3% Ni, 99% Cu and 1% Ni), and finally into the nearly 100% Cu and 0% Ni of the casting 904.

The nucleation points that occur during solidification are fixed in the outer edges of the sand mold and in the surface areas of the CuNi alloy coolant pipes and fittings. The grains of copper crystal constituting the fusion grow into the bulk of the copper casting as it solidifies. The copper crystal grains at these nucleation points will be the smallest in size because the copper is cooling first and then more rapidly here. In general, copper crystal grain sizes throughout the bulk will be random sized and generally exceed six millimeters after complete solidification.

CuNi-pipe-cast-in-copper furnace-block coolers require tight controls to eliminate casting defects. Fusion bonds between the outside surface area of the CuNi alloy coolant pipes that is too shallow, too deep, or not sufficiently widespread are defects. All but slight, unclustered portions (<15% of total) of the total outside surface area of the CuNi alloy coolant pipes with the Cu casting is necessary in high heat flux regime applications that exceed 25 $kW/m^2$ on the hot faces.

Figure 10:
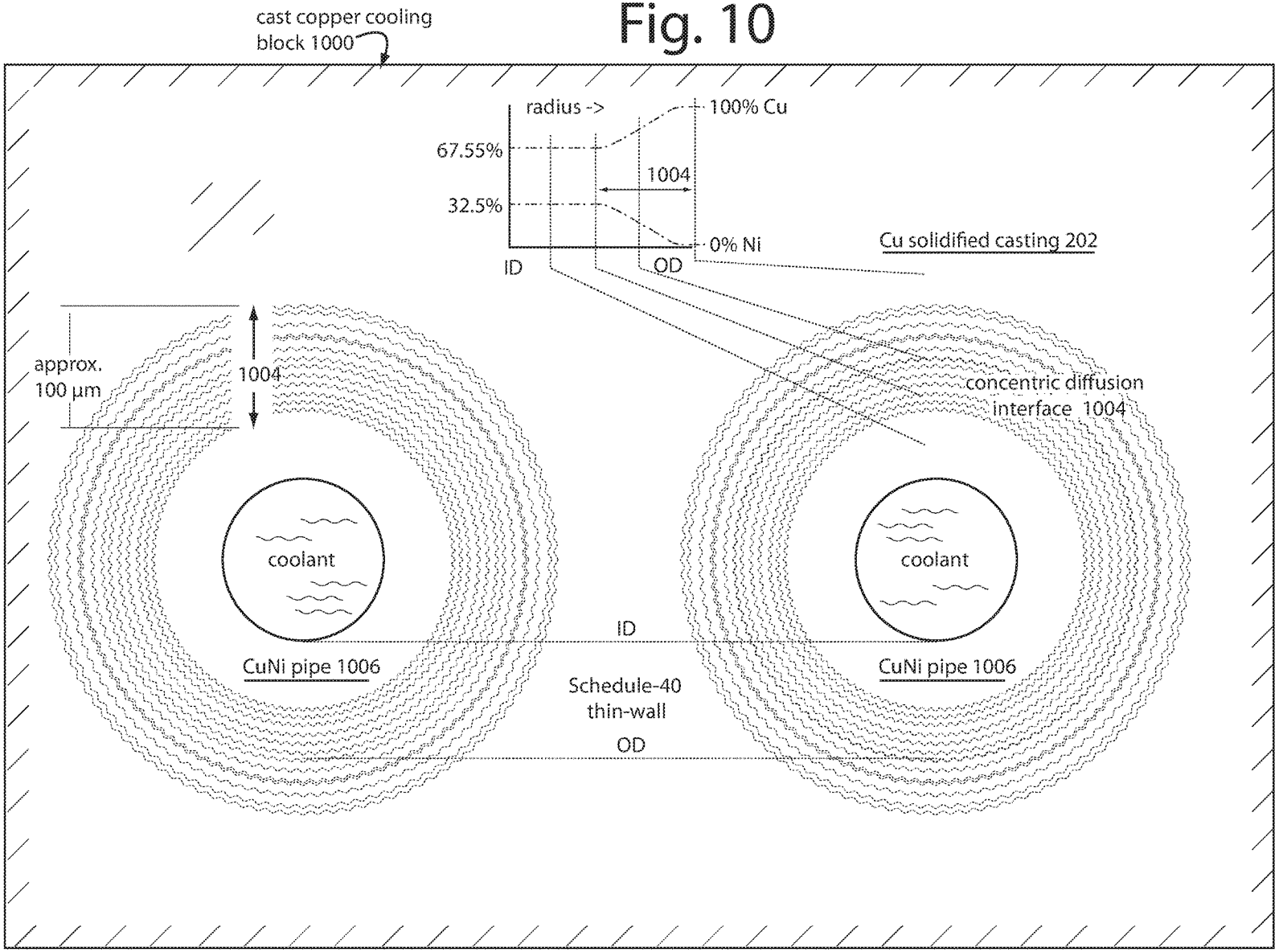
FIG. 10 is a cross-sectional diagram (not proportionate nor to scale) of a slice through the cast copper furnace-block cooler and fused-in CuNi alloy coolant pipe embodiment of the present invention, as in FIG. 1. This cross section intersects the CuNi alloy coolant pipes at two places to show the structure inside the solidified casting between the CuNi alloy coolant pipes. Around each pipe there is a metallurgically fused, concentric, and continuously transitioning diffusion zone a-f that is roughly 100 μm thick.

FIG. 10 represents a copper casting furnace-block cooler 1000 produced in a foundry by method embodiments of the present invention. The CuNi alloy coolant pipes and fittings have been metallurgically fused by the heat of a surrounding copper casting 1002 when it was poured in hot and liquid, then cooled and solidified in a mold. A concentric diffusion interface 1004 about 100 μm thick, and with crystal grain growth, is self formed when casting all around a respective CuNi alloy coolant pipe section 1006. The thermal conductivity through concentric diffusion interface 1004 is quite good, on the order of the bulk copper of the casting and the CuNi alloy coolant pipe walls. If metallurgical bonds were not uniformly established in the concentric diffusion interface 1004, the thermal resistance would be relatively quite high. Hot spots and thermal shear forces will develop wherever the metallurgical bonds failed to materialize.

Here, FIG. 10 represents with the insert chart of alloy-versus-radial-position, that the concentric diffusion interface 1004 continuously transitions through a stratified blend of copper alloys from 100% Cu and 0% Ni in the solidified casting 1002, and changes continuously (not in steps) to the 67.5% Cu and 32.5% Ni of the walls of the CuNi alloy coolant pipe 1006. (The inner walls never melt and their CuNi alloying is unaffected.)

Figure 11:
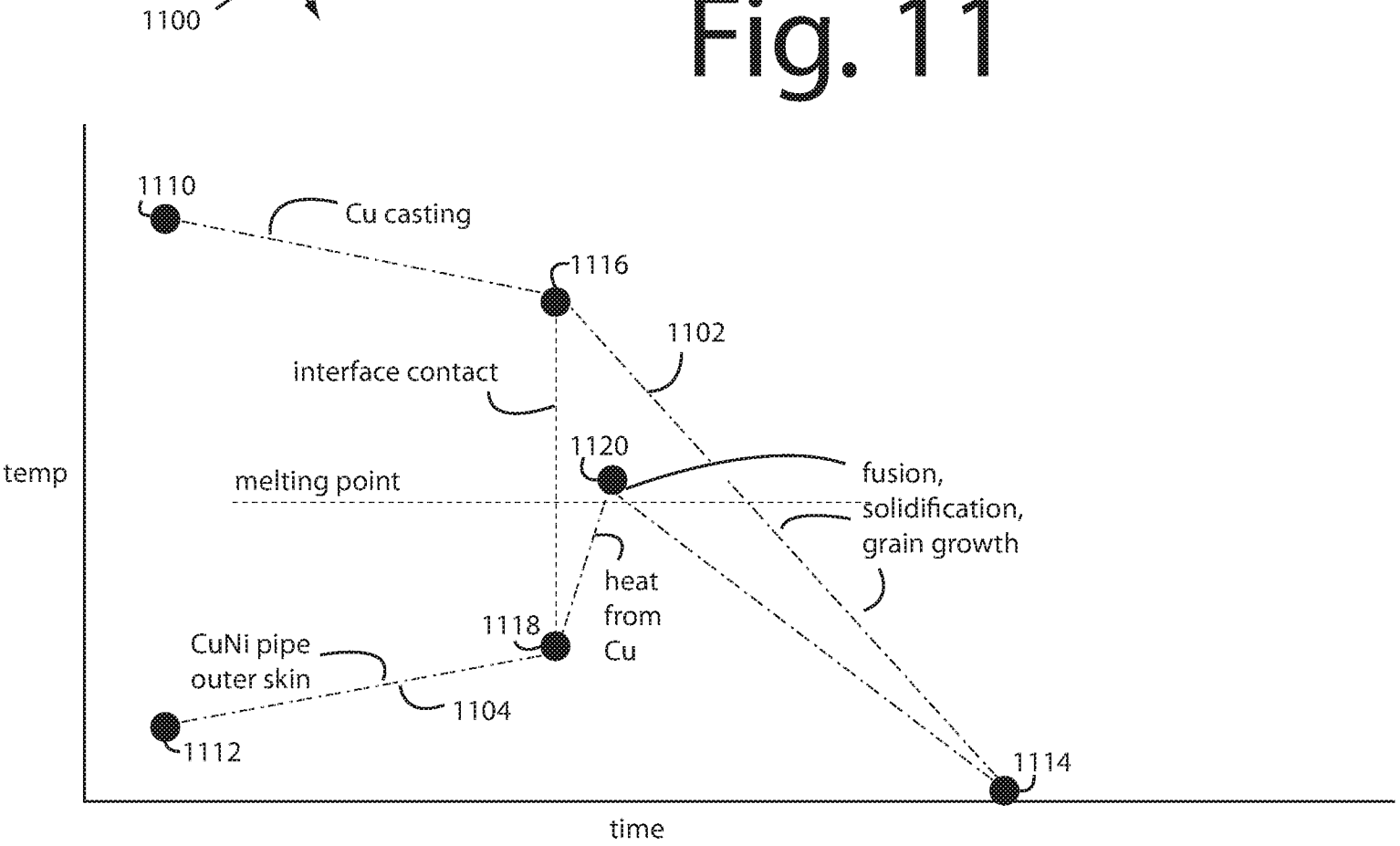
FIG. 11 is a graph drawing of the temperatures of the copper casting and CuNi alloy coolant pipes over time from just before a hot liquid pour into the sand mold through complete solidification and cooldown. The object is to show that all the heat necessary to bond and metallurgically fuse the interfaces of FIGS. 1 and 2 comes solely from the introduction into the mold of a heated and liquefied casting copper, and that on mutual contact only a surface skin of the CuNi alloy coolant pipes raises above melting to fuse, and then only briefly.

FIG. 11 is a graph drawing of the temperatures of the copper casting 202 (FIG. 2) and outer skins of the CuNi alloy coolant pipes 206 over time from just before a hot liquid is poured into the sand mold, then through complete solidification and cooldown. The object is to show that all the heat necessary for bonding and metallurgical fusing occurring in the concentric diffusion interfaces 106 and 204 of FIGS. 1 and 2 comes solely from the heated and liquefied casting copper introduced to the mold.

The various temperatures, geometries, and materials employed by the foundry are expertly manipulated such that on mutual contact, only a shallow surface skin part of the CuNi alloy coolant pipes raises above melting. And then only briefly.

FIG. 11 is a temperature-versus-time profile 1100 for both the copper of a casting 1102 and a CuNi alloy coolant pipe 1104, starting at the points-in-time 1110, 1112 just before a hot liquid copper is poured into the mold to flood over the CuNi alloy coolant pipe. The profile 1100 continues on until a point-in-time 1114 when solidification is complete.

Initially, before solidification, the Cu casting 1102 must be substantially hotter at point-in-time 1110 than the melting point of copper. Similarly, at the start, the CuNi alloy coolant pipe 1104 must be solid and therefore substantially below the melting point of copper at point-in-time 1112. The two eventually come into contact with one another at point-in-time 1116 (for the Cu copper 1102) and point-in-time 1118 (for the CuNi alloy coolant pipe 1104).

The contact of the hot liquid Cu casting 1102 with both the CuNi alloy coolant pipe 1104 and the walls of the mold take heat away. The outside skin of the CuNi alloy coolant pipe 1104 rises rapidly with the taken heat to just above melting at point-in-time 1120.

Figure 12:
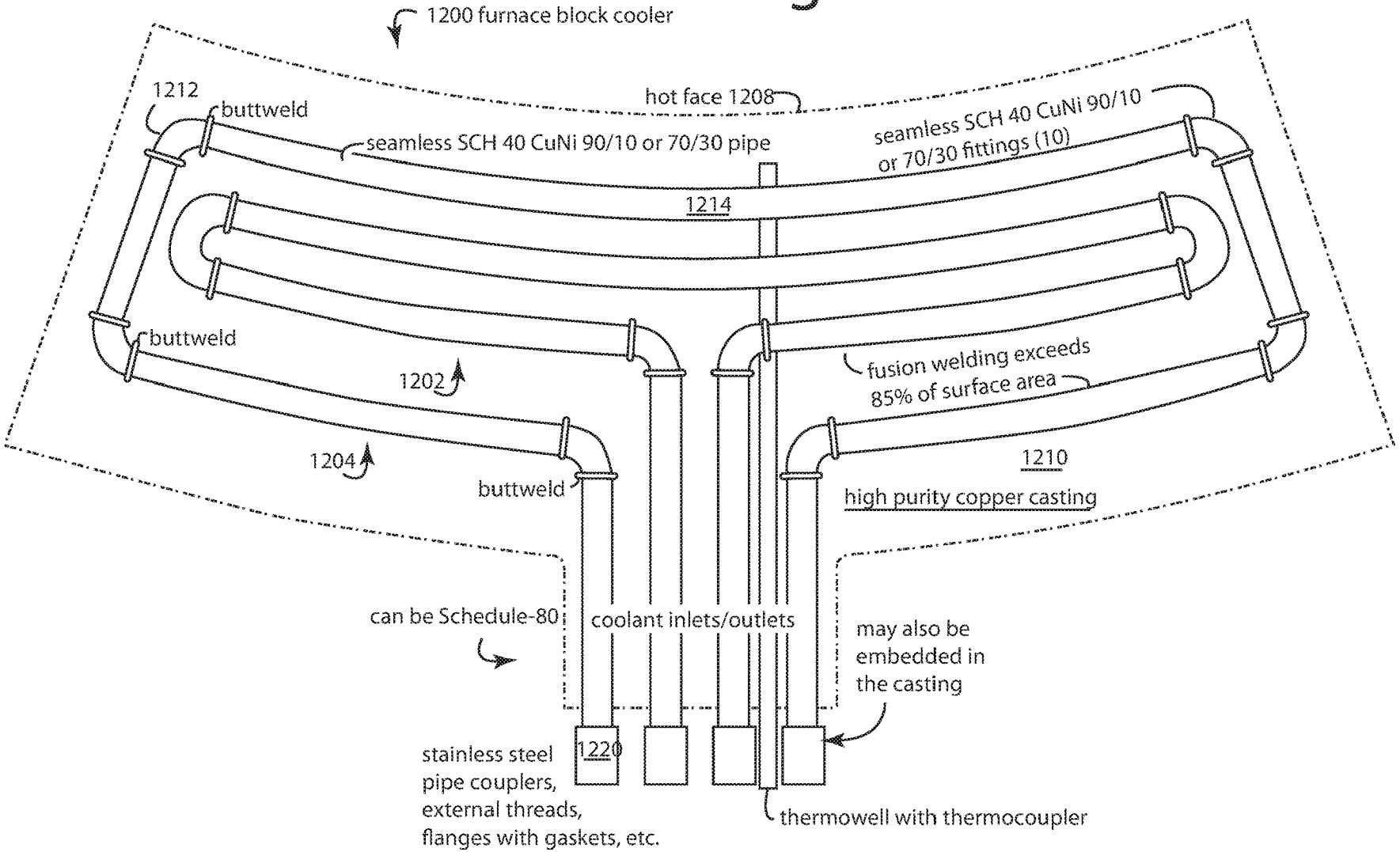
FIG. 12 is a plan view diagram of an cast copper furnace-block cooler and fused-in CuNi alloy coolant pipe embodiment of the present invention. The sharpest "1D" bends are normally made with CuNi fittings butt-welded in with the CuNi alloy coolant pipes and assembled and tested before casting in the mold. Two independent and synonymous CuNi alloy coolant pipe circuits share the heat load coming in from a single hot face (shown here at the top).

FIG. 12 is a plan view diagram of a cast copper furnace-block cooler and fused-in CuNi alloy coolant pipe embodiment 1200 of the present invention. Two independent and synonymous CuNi alloy coolant pipe circuits 1202 and 1204 together share a heat load 1206 coming in from a single hot face 1208. These are simultaneously cast inside a copper casting 1210 with the aid of metal chaplets, spacers, and bridging (not shown). The sharpest "1D" bends are normally made with CuNi fittings 1212 butt-welded in with the CuNi alloy coolant pipes 1214 and assembled and tested before casting in the mold. Each independent and synonymous CuNi alloy coolant pipe circuit terminates externally with factory welded stainless steel, external threads, flanges with gaskets, or other common types of inlet/outlet couplings 1220.

CuNi alloy coolant pipes are very difficult to weld together in the field. And so some embodiments of the furnace-block coolers herein require stainless steel couplers at the ends of the pipe inlets and outlets that are often partially embedded into the casting. The difficult, specialty welds of CuNi to stainless steel are exclusively done in the factory as part of the assembling of the ASTM Schedule-40 CuNi 70/30 standard 1.0", 1.25", 1.50", 1.75", and 2.0" pipes and butt-fuse fittings before casting. Only factories have the right environmental conditions, specialty equipment, and trained personnel to make good welds.

The CuNi alloy coolant pipes and fittings are preferably butt-welded together using TIG/GTAW. The CuNi alloy coolant pipes and fittings with 70/30 alloy is the most common material, but 90/10 alloy is possible.

Butt-welds are required at the fittings which often become necessary for complex and lengthy pipe coils. The butt-fused ends are beveled 37.5°±2.5° to penetration, especially in the larger diameters of 1.0", 1.25", 1.50", 1.75", and 2.0" inches.

One diameter (1D) radius bends are normally implemented with butt-weld fittings, and 1.5D or larger bends can be seamlessly cold formed or hot formed without much difficulty.

For a 1.0 inch ASTM Schedule-40 pipe, with an OD of 1.315 inches, the center line bend radius is 1.0 inch for short radius and 1.5 inch for long radius.

The most commonly used pipe sizes are 1.0-2.0 inch, all ASTM Schedule-40. It is uncommon to go outside this, e.g., 0.75 inch and 2.5 inch can be used, but less often.

Seamless pipes/fittings are always preferred.

ASTM Schedule-80 is preferred sometimes for the external inlets and outlets, for increased coupler strength. Cast-in thermowells commonly use ASTM Schedule-80. CuNi is also preferred for embedded thermowells in order to achieve metallurgical bonding and accurate temperature readings. And so, the accuracy of temperature readings obtained by thermocouples is improved by embedding and metallurgical bonding a thermowell or tubing of copper-nickel alloy in a method step of solidifying.

In general, stave cooler embodiments of the present invention include stave cooler bodies cast from a pour of hot liquid copper. A liquid coolant piping is a thin-wall alloy of copper such as MONEL, copper-nickel, and nickel-copper. Such is frozen in place in one or more independent circuits within the copper stave cooler body as a result of a single solidification of the stave cooler body in a foundry casting. The sought after benefit is a long-term thermal conductivity between the hot face and a circulating coolant that is stabilized and survives through repeated thermal cycles of the stave cooler.

The stave cooler bodies are cast from essentially pure copper and the liquid coolant piping is a thin-wall copper-nickel alloy. A welding occurs as a metallurgical bond along the liquid coolant piping entirety to and within the copper stave cooler body as a result of the heat pulse received from a single solidification of the stave cooler body in casting. Such metallurgical bonds thereby stabilize the long-term thermal conductivity between the hot face and a circulating coolant. Such survives through repeated thermal cycles of the stave cooler.

No doubt variations and modifications to the above will occur to artisans that have read and understood our disclosures here. Such variations and modifications are intended to be included in the scope of the Claims that follow.

The invention claimed is:

1. A single-mounting stave cooler for use in a furnace, comprising:

a cast iron stave body in which are fixed but not bonded a liquid coolant steel piping;

wherein, such absence of bonding prevents cracks in the cast iron stave body from propagating through into the liquid coolant steel piping;

a single protrusion and jacketing steel-to-steel welding collar with a proximal end embedded, or otherwise anchored into a backside of the cast iron stave body, and configured and relatively positioned to enable the stave cooler to hang and be entirely supported by a distal end passed from only inside and through a single gas-sealable penetration of a steel containment shell;

wherein, all external piping connections of the liquid coolant steel piping within are collected together as a single group and routed through and passing between the proximal and distal ends of the single steel-to-steel welding collar.

2. A stave cooler for a furnace that includes a liquid coolant piping cast inside, comprising:

a molded and machined stave cooler body of one of cast iron and cast copper with a hot face and a backside;

at least one circuit loop with inlet/outlet ends of a liquid coolant piping optimally positioned and distributed inside the stave cooler body between the hot face and the backside as determined in computer modelling;

a concentric diffusion interface between an outside surface area of the liquid coolant piping in contact internally with the stave cooler body; and a single steel collar which is at one end embedded and anchored into the stave cooler body on the backside to gas-seal and support an entire weight of the stave cooler from an opposite end, and through which any and every external inlet/outlet connection of the liquid coolant piping are collected and routed together;

a number of couplers welded to each of the inlet/outlet ends that are configured to connect externally to coolant hoses and further configured with welds that prevent an escape of process gases from a steel containment shell through the single steel collar;

wherein, the stave cooler is configured to be welded inside of the steel containment shell with a matching penetration at said opposite end.

3. The stave cooler of claim 2, wherein:

the stave cooler body is a single solidification of copper; and the liquid coolant piping is a thin-wall alloy of copper and nickel that is surface fused in place within the copper stave cooler body across the concentric diffusion interface;

wherein the concentric diffusion interface remains fused and therefore maintains a stabilized long-term thermal conductivity between the hot face and a circulating coolant that survives material stresses from repeated thermal cycles of the stave cooler.

4. The stave cooler of claim 2, wherein:

the stave cooler body is cast iron; and the liquid coolant piping is comprised of steel and is not bonded within the stave cooler body;

wherein, such lack of bonding is a barrier that prevents cracks from propagating into the liquid coolant piping from any that may develop in the cast iron stave cooler body.

5. The stave cooler of claim 2, wherein:

the single steel collar has a proximal end that is anchored into the backside of the stave cooler body and a distal end that is covered and sealed with welding around any inlets and outlets of the liquid coolant piping that are within, and couple to any external connections.

6. The stave cooler of claim 2, wherein:

the single steel collar has a proximal end that is welded on to a surface-exposed surface of an embedded annular steel ring and anchored into the backside of the stave cooler body.

* * * * *